US006836262B2

(12) United States Patent
Hashimoto et al.

(10) Patent No.: US 6,836,262 B2
(45) Date of Patent: Dec. 28, 2004

(54) METHOD OF DRIVING PLASMA DISPLAY PANEL, PLASMA DISPLAY DEVICE AND DRIVING DEVICE FOR PLASMA DISPLAY PANEL

(75) Inventors: Takashi Hashimoto, Tokyo (JP); Takahiro Urakabe, Tokyo (JP); Akihiko Iwata, Tokyo (JP); Yoshikazu Tsunoda, Tokyo (JP); Takayoshi Nagai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 240 days.

(21) Appl. No.: 09/782,292

(22) Filed: Feb. 14, 2001

(65) Prior Publication Data

US 2001/0017605 A1 Aug. 30, 2001

(30) Foreign Application Priority Data

Feb. 28, 2000 (JP) ..... P2000-051613
Nov. 16, 2000 (JP) ..... P2000-349839

(51) Int. Cl.[7] ..... G09G 3/28
(52) U.S. Cl. ..... 345/60; 315/169.4
(58) Field of Search ..... 345/60–72, 204, 345/208–212; 315/169.4, 169.1

(56) References Cited

U.S. PATENT DOCUMENTS 3,754,230 A * 8/1973 Auger ..... 345/69
4,683,470 A * 7/1987 Criscimagna et al. ..... 345/68
5,745,086 A 4/1998 Weber ..... 315/169.4
6,249,087 B1 * 6/2001 Takayama et al. ..... 315/169.1
6,456,263 B1 * 9/2002 Hashimoto et al. ..... 345/60
6,483,250 B1 * 11/2002 Hashimoto et al. ..... 315/169.4
6,512,501 B1 * 1/2003 Nagaoka et al. ..... 345/66
2002/0186186 A1 * 12/2002 Hashimoto et al. ..... 345/63

FOREIGN PATENT DOCUMENTS

| | | |
|---|---|---|
| JP | 6-289811 | 10/1994 |
| JP | 7-73811 | 3/1995 |
| JP | 7-140922 | 6/1995 |
| JP | 7-287548 | 10/1995 |
| JP | 10-91116 | 4/1998 |

* cited by examiner

*Primary Examiner*—Alexander Eisen
(74) *Attorney, Agent, or Firm*—Oblon, Spivak, McClelland, Maier & Neustadt, P.C.

(57) ABSTRACT

In a reset period, through applying a rectangular pulse (Pya) of positive polarity to an electrode (Y) and applying a CR pulse (Pxa) of negative polarity to an electrode X, a full lighting pulse is applied between the electrodes (X and Y). The application of the voltage is stopped before a CR pulse (Pxc) reaches a final potential, to generate the pulse (Pxa). A full erase pulse (Pxb) made of a CR pulse having a polarity reverse to that of the pulse (Pxa) is applied to the electrode (X). An erase operation reverses the polarity of wall charges accumulated by a full lighting to effectively perform a potential control operation. The potential control pulse (Pxc) is applied to the electrode (X) to generate a discharge, and the state of the wall charges in a discharge cell is controlled by the discharge to generate an optimal amount of wall charges for a subsequent addressing discharge. The final voltage of the pulse (Pxc) is set equal to a voltage (−Vxg) of an address pulse (Pa). Thus, it is possible to generate a plurality of pulses and stabilize an operation of a PDP with a simple constitution.

21 Claims, 21 Drawing Sheets

METHOD OF DRIVING PLASMA DISPLAY PANEL, PLASMA DISPLAY DEVICE AND DRIVING DEVICE FOR PLASMA DISPLAY PANEL

BACKGROUND OF THE INVENTION

1. Field of the Invention

The present invention relates to a method of driving a plasma display panel (hereinafter, also referred to as "PDP").

2. Description of the Background Art

Various studies have been made on a PDP as a thin-type television and a display monitor. Among the PDPs, there is a surface discharge AC-type PDP as one of AC-type PDPs having a memory function.

(Structure of PDP)

FIG. 28 is a perspective view showing an AC-type PDP 101 in the background art. The PDP of this structure is disclosed in Japanese Patent Application Laid Open Gazette Nos. 7-140922 and 7-287548.

The PDP 101 comprises a front glass substrate 102 as a display surface and a rear glass substrate 103 opposed to the front glass substrate 102 with a discharge space sandwiched therebetween.

On a surface of the front glass substrate 102 on the side of the discharge space 111, n sip-like electrodes 104*a* and *n* strip-like electrodes 105*a* which are paired respectively are extendedly formed. For convenience of illustration range, one electrode 104*a* and one electrode 105*a* are shown in FIG. 28. The electrodes 104*a* and 105*a* which are paired with each other are arranged with a discharge gap DG interposed therebetween. The electrodes 104*a* and 105*a* work to induce a discharge. Further, a transparent electrode is used for the electrodes 104*a* and 105*a* to extract more visible light, and hereinafter the electrodes 104*a* and 105*a* are also referred to as transparent electrodes 104*a* and 105*a*. Furthermore, in some cases, the electrodes 104*a* and 105*a* are made of the same material as metal (auxiliary) electrodes (or bus electrodes) 104*b* and 105*b* as discussed later are made of. On the transparent electrodes 104*a* and 105*a*, the metal (auxiliary) electrodes (or bus electrodes) 104*b* and 105*b* are formed extendedly along the transparent electrodes 104*a* and 105*a*. The metal electrodes 104*b* and 105*b* have impedance lower than those of the transparent electrodes 104*a* and 105*a*, and work to supply a current from a driving device.

In the following discussion, an electrode constituted of the transparent electrode 104*a* and the metal electrode 104*b* is referred to as a (row) electrode 104 (or X) and an electrode constituted of the transparent electrode 105*a* and the metal electrode 105*b* is referred to as a (row) electrode 105 (or Y). The row electrodes 104 and 105 (or row electrodes X and Y) which are paired with each other are also referred to as a pair of (row) electrodes 104 and 105 (or a pair of (row) electrodes X and Y). Further, in some cases, the row electrode 104 is constituted of only an electrode which corresponds to the electrode 104*a*, and/or the row electrode 105 is constituted of only an electrode which corresponds to the electrode 105*a*.

A dielectric layer 106 is formed covering the row electrodes 104 and 105 and a protection film 107 made of MgO (magnesium oxide) which is a dielectric substance is formed on a surface of the dielectric layer 106 by evaporation method and the like. The dielectric layer 106 and the protection film 107 are also generally referred to as a dielectric layer 106A. Further, in some cases, the dielectric layer 106A does not include the protection film 107.

On the other hand, on a surface of the rear glass substrate 103 on the side of the discharge space 111, m strip-like (column) electrodes 108 are so formed extendedly as to be orthogonal to (as to grade-separately intersect) the row electrodes 104 and 105. Hereinafter, the (column) electrode 108 is also referred to as a (column) electrode W. Furthermore, for convenience of illustration range, three electrodes 108 are shown in FIG. 28.

Between the adjacent column electrodes 108, a barrier rib 110 is formed extendedly in parallel with the column electrodes 108. The barrier ribs 110 separate a plurality of discharge cells (discussed later) arranged along the extending direction of the row electrodes 104 and 105 from each other and the barrier ribs 110 support the PDP 101 so as not to be crushed by atmospheric pressure.

Inside a substantial U-shaped trench constituted of the adjacent barrier ribs 110 and the rear glass substrate 103, a phosphor layer 109 is formed covering the column electrode 108. In more detail, in the above substantial U-shaped trenches, phosphor layers 109R, 109G and 109B for respective emitted light colors, red, green and blue are formed and for example, the phosphor layers 109R, 109G and 109B are arranged in this order in the entire PDP 101.

The front glass substrate 102 and the rear glass substrate 103 having the above structure are sealed with each other and the discharge space 111 between the front glass substrate 102 and the rear glass substrate 103 is filled with discharge gas such as Ne—Xe mixed gas or the He—Xe mixed gas under a pressure lower than the atmospheric pressure.

In the PDP 101, a discharge cell or a light emitting cell is formed at a (grade-separation) intersection of the row electrodes 104 and 105 and the column electrode 108. Specifically, three discharge cells are shown in FIG. 28.

(Principle of Operation of PDP)

Next, a principle of display operation of the PDP 101 will be discussed. First, a voltage or a voltage pulse is applied across the row electrodes 104 and 105 to generate a discharge in the discharge space 111. Then, by exciting the phosphor layer 109 with an ultraviolet ray generated by this discharge, the discharge cell emits light or lights up.

Charged particles such as electrons and ions generated in the discharge space 111 through this discharge move in a direction of the row electrode to which a voltage having a polarity reverse to that of the charged particles is applied and are accumulated on the surface of the dielectric layer 106A on the row electrode (referred to as "on the row electrode" hereinafter). The electric charges such as electrons and ions accumulated on the surface of the dielectric layer 106A are referred to as "wall charges."

Since the respective wall charges accumulated on the row electrodes 104 and 105 through the discharge form an electric field in a direction of weakening the electric field between the pair of the row electrodes 104 and 105, the discharge quickly disappears with formation and accumulation of the wall charges. When a voltage having polarity reverse to that of the above voltage is applied to the row electrodes 104 and 105 after the discharge disappears, an electric field in which the electric field generated by the applied voltage is superimposed on the electric field generated by the wall charges is substantially applied to the discharge space 111, in other words, a voltage in which the applied voltage is superimposed on the voltage (wall voltage) generated by the wall charges is substantially applied to the discharge space 111. The superimposed electric field can cause a discharge again.

Specifically, once the discharge is generated, continuous discharge (sustain discharge) can be caused by a voltage (sustain voltage) lower than the applied voltage used for starting the initial discharge through the electric field generated by the wall charges. Therefore, after the discharge is once generated, by alternately applying a pulse (sustain pulse) having an amplitude of sustain voltage to the row electrodes 104 and 105, in other words, by applying the sustain pulse across the row electrodes 104 and 105 with its polarity reversed, the discharge can be regularly sustained and continued (sustain operation).

Specifically, the discharge can be continued by continuously applying the sustain pulse until the wall charges disappear. Further, to extinguish the wall charges is referred to as "an erase operation" (or simply as "an erase") while to form the wall charges on the dielectric layer 106A at the start of continuous discharge (sustain discharge) is referred to as "a writing operation" (or simply as "a writing").

An actual image display is repeated with one field set within 16.6 ms, considering the human visual characteristics. At this time, in general, one field is divided into a plurality of subfields and the subfields have different luminances to make a gradation or tone. One subfield includes a reset period, an addressing period and a sustain period.

In the reset period, discharge (priming discharge) is generated in all the cells regardless of display history in order to enhance the discharge probability. Concurrently with this discharge, the wall charges are erased to erase the display history.

In the addressing period, a discharge cell is selected in matrix by combination of the row electrode 104 (105) and the column electrode 108 to generate a discharge (writing discharge or addressing discharge) in the predetermined discharge cell(s).

In the sustain period, discharges are repeatedly generated a predetermined number of times in the discharge cell(s) in which the writing discharge is generated in the addressing period. The luminance depends on the number of repeating generations of discharges.

In a predetermined discharge cell (or a plurality of predetermined discharge cells) among a plurality of discharge cells arranged in matrix, the writing discharge is first generated and then the sustain discharge is generated, to display characters, figures, images and the like. Further, by quickly performing the writing operation, the sustain operation and the erase operation, a movie display can be also performed. In this case, the number of tones can be increased by reducing the respective times of writing operation, sustain operation and erase operation. On the other hand, in a case of the same number of tones, a stable driving voltage margin can be obtained by increasing the respective operation times.

(Driving Method Using Round Pulse)

In general, as a sustain pulse used is a rectangular waveform or a rectangular pulse having a sharp rise, in other words, a rectangular pulse which rises fast. The rectangular pulse is used in order to generate an intense discharge by the sustain pulse and thereby generate a sufficient amount of wall charges. In more detail, in a case of using the rectangular pulse which rises sufficiently fast, the discharge starts after the rectangular pulse reaches a final attainment potential (or final attainment voltage; hereinafter, also referred to simply as a final potential (or final voltage)). Specifically, from the time when the applied voltage exceeds a firing voltage until the discharge is actually generated, there is a time lag called a discharge delay time. The applied rectangular pulse reaches the final potential before the discharge delay time passes. Therefore, since a sufficient high voltage is applied to the discharge space, a lot of wall charges are generated and accumulated.

In contrast to this, as the priming discharge and the like, a pulse of round waveform, i.e., a round pulse is used, in some cases. Since it is desirable that a discharge not for display luminescence, such as the priming discharge, is weak in terms of contrast, the round pulse which can generate a relatively weak discharge is used. Further, also when the wall charges are erased, a predetermined amount of wall charges are generated or the like, the round pulse is sometimes used.

When the rise time (and/or fall time) of the round pulse is longer than the discharge delay time and the round pulse rises (falls) sufficiently slow, a very weak discharge starts at the minimum voltage value. In the case of this discharge, the amount of movement of wall charges is very small and the discharge continues all the while the voltage continues to change after the discharge starts. In more detail, the discharge is once generated near the firing voltage to generate a very small amount of wall charges. Since the voltage across electrodes exceeds the firing voltage again with the continuous rise of the applied voltage, the discharge is generated again. By repeating generations of such a very small discharge, a weak discharge continues all the while the applied voltage continues to change. At this time, a predetermined amount of wall charges which depend on the final potential of the round pulse are stably generated. Furthermore, it is possible to extinguish the wall charges, depending on the application polarity and the final potential of the round pulse.

The round pulse mainly includes two types of pulses, i.e., a "CR waveform (or CR pulse)" and a "ramp waveform (or ramp pulse)". These waveforms will be discussed below.

The CR pulse is obtained when a capacitance element is charged (or discharged) through a resistance element. When a capacitance element C having a voltage of 0 in an initial state is charged by a power supply having a voltage V0(>0) through a resistance element R, a voltage of the capacitance element C, i.e., a voltage v(t) of the CR pulse is expressed as $$v(t)=V0\times(1-\exp(-t/\tau))$$

where t represents time and $\tau$ is a time constant expressed by a product of the capacitance element C and the resistance element R ($\tau=C\times R$). Since the voltage v(t) includes a term of exponential function, the waveform of the voltage v(t) is sometimes termed "an exponential waveform".

The rate of change dv(t)/dt (hereinafter, also referred to as "dv/dt") of the voltage v(t) with respect to time t is obtained as $$dv(t)/dt=(V0/\tau)\times\exp(-t/\tau)$$

It can be seen from this equation that the rate of voltage change dv(t)/dt of the CR pulse is large immediately after the application and gradually becomes smaller with time. Since the PDP is a capacitive load, as discussed earlier, the CR pulse can be applied to the electrode of the PDP or the capacitance element only by supplying the voltage to the electrode through a resistance.

On the other hand, the voltage v(t) of the ramp pulse is in proportion to an application time t, and in other words, it increases (or decreases) at a constant rate of voltage change dv/dt. With the ramp pulse, unlike with the CR pulse, the discharge can be started always at a constant rate of voltage change, not depending on variation in firing voltage. Therefore, it is possible to absorb variation in discharge characteristics of the discharge cells and suppress variation in light emission all over the PDP.

(Method of Driving PDP)

Referring to a timing chart of FIG. 29, a first background-art driving method will be discussed. The timing chart of FIG. 29 is disclosed in, e.g., Japanese Patent Application Laid Open Gazette No. 10-91116.

In this driving method, one subfield is divided into four periods, i.e., a reset period, an addressing period, a sustain period and an erase period. In the reset period, all the cells are discharged or lighted, regardless of a display history, to perform a writing. Since the discharge in the reset period leads to luminescence even on a black screen display, it causes deterioration in contrast. For this reason, a CR pulse 620 is applied to the row electrodes X and Y to suppress the amount of light emission. Further, a CR pulse 620 having a negative polarity is applied to the row electrode Y and a CR pulse 620 having a positive polarity is applied to the row electrode X.

In the addressing period, a predetermined voltage is applied between the row electrode X and the column electrode W belonging to a discharge cell(s) not to be illuminated in the subsequent sustain period, to erase the wall charges in the discharge cell(s).

The above addressing method in which the wall charges are generated in all the discharge cells and then the wall charges in the discharge cell(s) not to be illuminated are erased is termed "an erase addressing method". On the other hand, an addressing method in which the discharge is generated only in the discharge cell(s) to be illuminated to accumulate the wall charges is termed "a write addressing method".

In the sustain period, an AC pulse is applied to the row electrodes X and Y to generate the discharge(s) in the discharge cell(s) in which the wall charges remain because no addressing discharge is generated. This discharge illuminates the discharge cell(s). The luminance of light emission is controlled by the number of applications of the AC pulses. In the erase period, the wall charges in the discharge cell(s) illuminated in the sustain period are reduced or erased.

Next, a second background-art driving method will be discussed, referring to a timing chart of FIG. 30. The timing chart of FIG. 30 is disclosed in, e.g., U.S. Pat. No. 5,745,086.

Also in this driving method, one subfield is divided into four periods, i.e., the reset period, the addressing period, the sustain period and the erase period. Further, in the specification of the above USP, the erase period and the reset period are generally referred to as a setup period.

In the reset period, a ramp pulse or a trapezoidal pulse 610 of which voltage value changes at a constant rate of voltage change is applied to all the row electrodes X. At this time, considering that the intensity of discharge (in other words, the amount of movement of wall charges) largely depends on the rising rate of the voltage or the rate of voltage change, it is necessary to set the rate of voltage change at the rise of the ramp pulse sufficiently gentle in order to suppress the discharge or luminance of light emission.

After the wall charges are generated by the discharge at the rise of the ramp pulse 610, a voltage is applied to the row electrodes Y and the voltage applied to the row electrodes X, i.e., the ramp pulse 610 is gently lowered. At this fall, a discharge is generated to perform a full erase. At this fall, like at the rise, it is possible to suppress the luminance by setting the rate of voltage change sufficiently gentle.

In the addressing period, a scanning pulse (or address pulse) and an address data pulse are applied to the row electrodes X and the column electrode W, respectively, belonging to the discharge cell(s) to be illuminated in the subsequent sustain period, to generate an addressing discharge in the discharge cell(s) (write addressing method). In the sustain period, discharge or luminescence are generated in the discharge cell(s) in which the wall charges are accumulated by generating the addressing discharge. The luminance of light emission is controlled by the number of applications of the AC pulses.

In the erase period, a ramp pulse 611 which is sharper than the ramp pulse 610 applied in the reset period is applied to generate a discharge, thereby reducing or erasing the wall charges in the discharge cell(s) illuminated in the sustain period. It is shown in the second background-art driving method that with this operation, a stable driving voltage margin can be obtained.

Next, a third background-art driving method will be discussed, referring to a timing chart of FIG. 31. The timing chart of FIG. 31 is disclosed in, e.g., Japanese Patent Application Laid Open Gazette No. 6-289811.

In a case of using the write addressing method, first, a discharge is generated in the column electrode W and the row electrode X and then with this discharge used as a trigger, a discharge is generated between the row electrode X and the row electrode Y. With this discharge between the row electrodes X and Y, the wall charges are generated on the row electrodes X and Y.

At this time, as shown in FIG. 31, a secondary scanning pulse 650 is applied to the row electrode Y during the addressing period in the third background-art driving method. It is shown that the discharge can be reliably shifted from that between the column electrode W and the row electrode X to that between the row electrodes X and Y by forming a sufficient electric field between the row electrodes X and Y with the secondary scanning pulse 650.

Also in the second background-art driving method (see FIG. 30), a voltage almost equal to the sustain pulse is applied to the row electrode Y during the addressing period. The voltage applied during the addressing period, however, is continuously applied from the reset period with same voltage value, and such a pulse as applied thus is not exactly the secondary scanning pulse. This is because the secondary scanning pulse is a pulse to enlarge an operating margin by using an applied voltage different from that used in the reset period, in other words, by controlling the value of the applied voltage in the addressing period and that in the reset period independently of each other.

The CR pulse has the following problems. First, when the discharge is started in a time region where the rate of voltage change dv/dt is sharp immediately after application, a strong discharge is generated like in the case of using the rectangular pulse. When such a strong discharge is generated in the reset period, the luminance irrelevant to the display emission increases and this causes deterioration in contrast. Further, when the movement of the wall charges during generation of the strong discharge is too larger than the inclination of the applied waveform, the very weak discharge caused by the round pulse can not be continued. In this case, it is impossible to take full advantage of the characteristic feature of the round pulse that the amount of accumulated wall charges can be controlled by the final potential of the applied waveform. Therefore, it is necessary to design a driving sequence so that a discharge can be started in a region where the rate of voltage change dv/dt is sufficiently gentle.

Since the voltage of the ramp pulse rises at a constant inclination, even if there is variation in firing voltage among the discharge cells, it is possible to suppress this variation and obtain a sufficiently low luminance. The ramp pulse is more advantageous than the CR pulse in this point. Since the ramp pulse needs a longer time for its voltage to reach the firing voltage than the CR pulse, however, the ramp pulse sometimes needs a longer application time than the CR pulse.

The first background-art driving method has the following problems. Since the respective CR pulses 620 applied to the row electrodes X and Y in the reset period of this driving method have polarities reverse to each other, the rate of change in potential difference between the row electrodes X and Y is larger than the rate of voltage change of the CR pulse 620. Therefore, though the CR pulse 620 is applied to the row electrodes X and Y, the characteristic feature of the CR pulse can not be sufficiently obtained and for example, deterioration in contrast is liable to be caused. Further, since the first background-art driving method uses the CR pulse 620, it is disadvantageously impossible to sufficiently absorb variation in discharge characteristics among the discharge cells, unlike in the case of using the ramp pulse 610 (of FIG. 30).

The second background-art driving method has the following problem. In the reset period of this driving method, application of the ramp pulse 610 to the row electrode X is started with the potential of the row electrode Y set to the ground potential (GND). At this time, since the potential difference between the electrodes X and W is equal to that between the electrodes X and Y, a discharge is also generated between the electrodes X and W. Though very weak, this discharge disadvantageously deteriorates the phosphor 110 layer on the column electrode W.

In contrast to this, in the reset period of the first background-art driving method, since the positive CR pulse 620 is applied to the row electrode X while the negative CR pulse 620 is applied to the row electrode Y, the potential of the column electrode W becomes an intermediate potential of those of the row electrodes X and Y, and therefore it is believed that it is hard to generate any discharge in the column electrode W. Since the CR pulse 620 having a voltage high enough to generate a discharge between the row electrodes X and Y is applied, however, a discharge may be sometimes generated on the column electrode W and the phosphor layer may be deteriorated in such a case.

It is possible to generate a certain amount of wall charges by using a round pulse which gently rises (and falls), like in the first and second background-art driving methods. Since the amount of wall charges depends on the final voltage of the round pulse, however, when a plurality of round pulses are used, it is necessary to provide a plurality of round pulse generation circuits in accordance with the necessary final voltages and therefore the cost disadvantageously becomes high.

Similarly, since it is necessary to additionally provide a circuit for generating the secondary scanning pulse 650 in the third background-art driving method, the cost becomes high also in this case.

Further, since application time of the round pulse is longer than that of the rectangular pulse, when the reset period is set in all the subfields like in the first and second background-art driving method, it is necessary to reduce the sustain period and the like or reduce the number of subfields in one field. Reducing the sustain period and the like causes an unstable operation and deterioration in display quality. This problem becomes more pronounced as the number of subfields in one field increases. Furthermore, when the reset period is set in all the subfields, the luminance irrelevant to the display emission thereby disadvantageously becomes high.

Further, the background-art PDP has a problem of flicker in image caused by the longer discharge delay time in generation of the addressing discharge (or writing discharge). This problem will be discussed, referring to FIGS. 32 to 36.

First, a timing chart used for explaining a discharge delay time in the addressing period is shown in FIG. 32. FIG. 32 shows waveforms of a voltage applied to the column electrode W, a voltage applied to the row electrode X and discharge intensity. The waveform of discharge intensity can be obtained by measuring the intensity of infrared ray radiated by the discharge with a photodetector using photodiode (i.e., photoprobe).

As shown in FIG. 32, in the addressing period, the addressing discharge starts behind the point of time when the application of an address pulse Pa and a data pulse Pd starts by a discharge delay time $\tau d$. For this reason, to ensure the writing operation, it is necessary to apply the address pulse Pa and the data pulse Pd until the discharge grows to accumulate wall charges also after the addressing discharge starts. In other words, to ensure the writing operation, the discharge delay time $\tau d$ has to be not longer than a predetermined time period (hereinafter referred to also as "address limit time width") $\tau th$ (see FIG. 34 discussed below) which is shorter than the pulse width (hereinafter referred to also as "addressing time width") $\tau w$ of the address pulse Pa and the data pulse Pd.

The discharge delay time $\tau d$ is not constant, probabilistically changing. Therefore, when the discharge delay time $\tau d$ is almost equal to the address limit time width $\tau th$ or longer, the addressing discharge is not probabilistically generated in some cases. In such a case, a discharge cell which should be lighted is not lighted (in a case of write addressing method) or a discharge cell which should not be lighted is wrongly lighted (in a case of erase addressing method) in the sustain period. As a result, problems such as flicker in image arise.

The probability distribution of the discharge delay time $\tau d$ depends on the content of the display image. This will be discussed, referring to FIGS. 33 to 36. FIGS. 33 and 35 are schematic views of PDPs, used for explaining a full lighting display and a solitary lighting display, respectively, and FIGS. 34 and 36 are schematic views used for explaining probability distribution of the discharge delay time $\tau d$ in the full lighting display and the solitary lighting display, respectively. Further, in FIGS. 33 and 35, a lighting discharge cell C is represented by solid circle (●) and a not-lighting discharge cell C is represented by blank circle (○).

The full lighting display refers to a state where all the discharge cells C arranged in matrix are lighted as shown in FIG. 33. On the other hand, the solitary lighting display refers to a state where the lighting discharge cells C are scattered and the discharge cells C surrounding the lighting discharge cell C are not lighted as shown in FIG. 35.

As shown in FIG. 34, when the content of the display image is the full lighting display, the discharge delay time $\tau d$ is shorter than the addressing time width $\tau w$ and the address limit time width $\tau th$, and its distribution falls in a narrow time range. On the other hand, as shown in FIG. 36, when the content of the display image is the solitary lighting display, the distribution of the discharge delay time $\tau d$ is wide (varies) and extends beyond the addressing time width $\tau w$ and the address limit time width $\tau th$ in a wide time range. In this case, when the discharge delay time $\tau d$ exceeds the address limit time width $\tau th$, no addressing discharge is generated.

The reason for the difference of distribution between FIGS. 34 and 36 is considered as follows. In the case of the full lighting display, when the addressing discharge is generated in a discharge cell, the priming particles generated by the addressing discharge are diffused to the discharge cells therearound and a priming effect is produced in the discharge cell in which the addressing discharge is generated next. In contrast to this, in the case of solitary lighting display, there is no source for priming particles around the discharge cell in which the addressing discharge is generated. This is considered to produce the above difference in the distribution of the discharge delay time τd.

As discussed above, the distribution of the discharge delay time τd extends beyond the addressing time width τw and the address limit time width τth in a wide range (see FIG. 36). Therefore, some lighting problem is more likely to arise in the solitary lighting display than in the full lighting display. In this case, it is considered that writing probability is raised (a) by widening the pulse width of the address pulse Pa (in other words, by making the addressing time width τw longer), or (b) by raising the voltage of the address pulse Pa (address voltage), to reduce the flicker. Further, the writing probability refers to a probability of completing the writing operation within the address limit time width τth, in other words, a probability that the discharge delay time rd is shorter than the address limit time width τth.

When the pulse width of the address pulse Pa is widened (a), however, since the addressing period becomes longer, the ratio of the addressing period in one subfield becomes larger. As a result, for example, the sustain period has to be shorten, and another problem such as deterioration in luminance arises. On the other hand, when the voltage of the address pulse Pa is raised (b), an address driving device of high breakdown voltage is needed, and the cost for the driving device is disadvantageously raised.

Japanese Patent Application Laid Open Gazette No. 10-91116, as shown in FIG. 29, discloses a driving method in which an operation for generating a priming discharge by applying a priming pulse 623 before the application of an address pulse 622 by a predetermined time is performed for each row. In the driving method, since the priming particles are generated immediately before the addressing operation, the flicker in image is relatively unlikely to occur even in the case of solitary lighting display.

In the driving method of FIG. 29, however, since the address pulse 622 and the priming pulse 623 are sequentially applied for each row, the waveform of application voltage is complicated and accordingly the driving device becomes complicated. As a result, the cost is disadvantageously raised. Further, the luminescence by the priming discharge is observed as background luminescence, in other words, luminescence in black display, and therefore there arises a problem that the contrast can not become so high.

SUMMARY OF THE INVENTION

The present invention is directed to a method of driving a plasma display panel which comprises a discharge cell including a first electrode and a second electrode, capable of controlling generation/non-generation of discharge with potential difference between the first electrode and the second electrode.

(1) According to a first aspect of the present invention, in the method of driving a plasma display panel, a pulse generation system for generating a voltage pulse which continuously changes from a first voltage to a second voltage is prepared, and application of the voltage pulse to the first electrode is started by using the pulse generation system, and then the change of the voltage pulse is stopped at the point of time when the voltage pulse reaches a third voltage between the first voltage and the second voltage.

(2) According to a second aspect of the present invention, in the method of the first aspect, the third voltage is set on the side of the second voltage relative to a firing voltage, and the voltage pulse reaches the third voltage after a time longer than a discharge delay time passes from the point of time when the voltage pulse exceeds the firing voltage.

(3) According to a third aspect of the present invention, in the method of the first or second aspect, the voltage pulse includes at least one of a CR voltage pulse, a ramp voltage pulse and an LC resonant voltage pulse.

(4) According to a fourth aspect of the present invention, in the method of the third aspect, a rectangular pulse generation system for generating a rectangular voltage pulse is further prepared, and a voltage pulse in which one of the CR voltage pulse, the ramp voltage pulse and the LC resonant voltage pulse is superimposed on the rectangular voltage pulse is applied between the first electrode and the second electrode by using the pulse generation system and the rectangular pulse generation system.

(5) According to a fifth aspect of the present invention, in the method of any one of the first to fourth aspects, when one field for image display is divided into a plurality of subfields each including an addressing period and a sustain period set after the addressing period, whether the discharge cell should be illuminated or not in the sustain period is determined in the addressing period and the discharge cell is illuminated in the sustain period if it is determined in the addressing period that the discharge cell should be illuminated, application of the voltage pulse is started and stopped in a period other than the addressing period and the sustain period in at least one of the subfields in the one field.

(6) According to a sixth aspect of the present invention, in the method of the fifth aspect, at least one of an operation for generating a discharge in the discharge cell regardless of a display history and an operation for generating a discharge in the discharge cell only when the discharge cell is illuminated in the immediately preceding sustain period is performed with the voltage pulse.

(7) According to a seventh aspect of the present invention, in the method of the fifth or sixth aspect, application of the voltage pulse to the first electrode is started before the addressing period, and the third voltage of the voltage pulse is set to a value between a ground potential and an address voltage to be applied to the first electrode in the addressing period in determining that the discharge cell should be illuminated in the sustain period.

(8) According to an eighth aspect of the present invention, in the method of driving a plasma display panel, one field for image display is divided into a plurality of subfields each including an addressing period and a sustain period set after the addressing period, an address voltage is applied to the first electrode and whether the discharge cell should be illuminated or not in the sustain period is determined in the addressing period, and the discharge cell is illuminated in the sustain period when it is determined in the addressing period that the discharge cell should be illuminated. The method comprises the steps of: (a) applying a first voltage pulse having the same polarity as the address voltage has to the first electrode for generating a discharge to generate wall charges in the discharge cell; and (b) applying a second voltage pulse having the same polarity as the first voltage pulse has to the first electrode for generating a discharge to control the state of the wall charges, and in the method of the eighth aspect, both the steps (a) and (b) are performed before the addressing period and the step (b) is performed after the step (a), and the first voltage pulse and the second voltage pulse have waveforms of which absolute values continuously increase toward a predetermined polarity.

(9) According to a ninth aspect of the present invention, the method of the eighth aspect further comprises the step of: (c) applying a third voltage pulse having a polarity reverse to that of the first voltage pulse to the first electrode, and in the method of the ninth aspect, the step (c) is performed between the step (a) and the step (b), and the third voltage pulse has a waveform of which absolute value continuously increases toward a predetermined polarity.

(10) According to a tenth aspect of the present invention, the method of the eighth or ninth aspect further comprises the step of: (d) reducing the wall charges in the discharge cell, and in the method of the tenth aspect, the step (d) is performed before the step (a).

(11) According to an eleventh aspect of the present invention, in the method of the tenth aspect, the step (d) comprises the steps of: (d-1) applying a fourth voltage pulse between the first electrode and the second electrode to generate a discharge in the discharge cell; and (d-2) applying a fifth voltage pulse between the first electrode and the second electrode to generate a discharge in the discharge cell, and in the method of the eleventh aspect, the step (d-1) and the step (d-2) are sequentially performed, the fourth voltage pulse is a voltage pulse which is capable of generating a discharge at the rise and the fall of the fourth voltage pulse, and the fifth voltage pulse has a waveform of which absolute value continuously increases toward a predetermined polarity.

(12) According to a twelfth aspect of the present invention, the present invention is directed to the method of driving a plasma display panel which comprises a discharge cell including a first electrode and a second electrode, capable of controlling generation/non-generation of discharge with potential difference between the first electrode and the second electrode, and in the method of driving a plasma display panel, a discharge is sequentially generated in the discharge cell by sequentially applying two voltage pulses between the first electrode and the second electrode, a latter voltage pulse which is applied later among the two voltage pulses changes more gently than a former voltage pulse which is applied first among the two voltage pulses, and the latter voltage pulse is applied in a period while priming particles generated in the discharge by the former voltage pulse remain in the discharge cell.

(13) According to a thirteenth aspect of the present invention, in the method of driving a plasma display panel, the discharge is generated in the discharge cell during an 110 operation for defining whether the discharge cell is illuminated for display or not, regardless of whether the discharge cell is illuminated for display or not.

(14) According to a fourteenth aspect of the present invention, in the method of driving a plasma display panel of the thirteenth aspect, the plasma display panel comprises a plurality of the discharge cells, and the discharge includes a first discharge and a second discharge weaker than the first discharge, the method of driving a plasma display panel includes the operations, as the operation for defining whether the discharge cell is illuminated for display or not, of: sequentially applying an address pulse to the first electrode of each of the plurality of discharge cells to sequentially select the plurality of discharge cells, generating the first discharge in a selected one of the plurality of discharge cells when a data pulse is applied to the second electrode of the selected discharge cell, and generating the second discharge in the selected discharge cell when the data pulse is not applied to the second electrode of the selected discharge cell.

(15) According to a fifteenth aspect of the present invention, in the method of driving a plasma display panel of the thirteenth or fourteenth aspect, a pulse generation system for generating a voltage pulse which continuously changes from a first voltage to a second voltage is prepared, and application of the voltage pulse to the first electrode is started by using the pulse generation system, then the change of the voltage pulse is stopped at the point of time when the voltage pulse reaches a third voltage between the first voltage and the second voltage, and thereafter the operation for defining whether the discharge cell is illuminated for display or not is performed.

The present invention is also directed to a plasma display device.

(16) According to a sixteenth aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the twelfth aspect, the driving unit comprises a pulse generation unit capable of generating a voltage pulse which continuously changes from a first voltage to a second voltage, and the driving unit controls the pulse generation unit to start outputting the voltage pulse as a voltage to be applied to the first electrode and then to stop the change of the voltage pulse at the point of time when the voltage pulse reaches a third voltage between the first voltage and the second voltage.

(17) According to a seventeenth aspect of the present invention, in the plasma display device of the sixteenth aspect, the third voltage is set on the side of the second voltage relative to a firing voltage, and the voltage pulse reaches the third voltage after a time longer than a discharge delay time passes from the point of time when the voltage pulse exceeds the firing voltage.

(18) According to an eighteenth aspect of the present invention, in the plasma display device of the sixteenth or seventeenth aspect, the voltage pulse includes at least one of a CR voltage pulse, a ramp voltage pulse and an LC resonant voltage pulse.

(19) According to a nineteenth aspect of the present invention, in the plasma display device of the eighteenth aspect, the pulse generation unit is capable of generating a rectangular voltage pulse, and the driving unit controls the pulse generation unit to output a voltage pulse in which one of the CR voltage pulse, the ramp voltage pulse and the LC resonant voltage pulse is superimposed on the rectangular voltage pulse, as a voltage to be applied between the first electrode and the second electrode.

(20) According to a twentieth aspect of the present invention, in the plasma display device of any one of the sixteenth to nineteenth aspects, when one field for image display is divided into a plurality of subfields each including an addressing period and a sustain period set after the addressing period, whether the discharge cell should be illuminated or not in the sustain period is determined in the addressing period and the discharge cell is illuminated in the sustain period if it is determined in the addressing period that the discharge cell should be illuminated, the driving unit starts and stops applying the voltage pulse in a period other than the addressing period and the sustain period in at least one of the subfields in the one field.

(21) According to a twenty-first aspect of the present invention, in the plasma display device of the twentieth aspect, the driving unit performs, with the voltage pulse, at least one of an operation for generating a discharge in the discharge cell regardless of a display history and an operation for generating a discharge in the discharge cell only when the discharge cell is illuminated in the immediately preceding sustain period.

(22) According to a twenty-second aspect of the present invention, in the plasma display device of the twentieth or twenty-first aspect, the driving unit starts outputting the voltage pulse as a voltage to be applied to the first electrode before the addressing period, and the third voltage of the voltage pulse is set to a value between a ground potential and an address voltage applied to the first electrode in the addressing period in determining that the discharge cell should be illuminated in the sustain period.

(23) According to a twenty-third aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the nineteenth aspect, one field for image display is divided into a plurality of subfields each including an addressing period and a sustain period set after the addressing period, an address voltage is applied to the first electrode and whether the discharge cell should be illuminated or not in the sustain period is determined in the addressing period, and the discharge cell is illuminated in the sustain period when it is determined in the addressing period that the discharge cell should be illuminated. Further, in the plasma display panel of the nineteenth aspect, the driving unit performs the steps of: (a) generating a first voltage pulse having the same polarity as the address voltage has, for generating a discharge in the discharge cell to generate wall charges, and outputting the first voltage pulse as a voltage to be applied to the first electrode; and (b) generating a second voltage pulse having the same polarity as the first voltage pulse has, for generating a discharge in the discharge cell to control the state of the wall charges, and outputting the second voltage pulse as a voltage to be applied to the first electrode, both the steps (a) and (b) are performed before the addressing period and the step (b) is performed after the step (a), and the first voltage pulse and the second voltage pulse have waveforms of which absolute values continuously increase toward a predetermined polarity.

(24) According to a twenty-fourth aspect of the present invention, in the plasma display device of the twenty-third aspect, the driving unit further performs the step of: (c) generating a third voltage pulse having a polarity reverse to that of the first voltage pulse and outputting the third voltage pulse as a voltage to be applied to the first electrode, the step (c) is performed between the step (a) and the step (b), and the third voltage pulse has a waveform of which absolute value continuously increases toward a predetermined polarity.

(25) According to a twenty-fifth aspect of the present invention, in the plasma display device of the twenty-third or twenty-fourth aspect, the driving unit further performs the step of: (d) reducing the wall charges in the discharge cell, and the step (d) is performed before the step (a).

(26) According to a twenty-sixth aspect of the present invention, in the plasma display device of the twenty-fifth aspect, the driving unit sequentially performs, in the step (d), the steps of: (d-1) generating a fourth voltage pulse for generating a discharge in the discharge cell and outputting the fourth voltage pulse as a voltage to be applied between the first electrode and the second electrode; and (d-2) generating a fifth voltage pulse for generating a discharge in the discharge cell and outputting the fifth voltage pulse as a voltage to be applied between the first electrode and the second electrode, the fourth voltage pulse is a voltage pulse which is capable of generating a discharge at the rise and the fall of the fourth voltage pulse, and the fifth voltage pulse has a waveform of which absolute value continuously increases toward a predetermined polarity.

(27) According to a twenty-seventh aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the twenty-seventh aspect, the driving unit sequentially applies two voltage pulses between the first electrode and the second electrode to sequentially generate a discharge in the discharge cell, a latter voltage pulse which is applied later among the two voltage pulses changes more gently than a former voltage pulse which is applied first among the two voltage pulses, and the driving unit applies the latter voltage pulse in a period while priming particles generated in the discharge by the former voltage pulse remain in the discharge cell.

(28) According to a twenty-eighth aspect of the present invention, the plasma display device comprises a plasma display panel comprising a discharge cell including a first electrode and a second electrode; and a driving unit for driving the discharge cell by giving a potential difference between the first electrode and the second electrode, and in the plasma display device of the twenty-eighth aspect, the driving unit generates the discharge in the discharge cell during an operation for defining whether the discharge cell is illuminated for display or not, regardless of whether the discharge cell is illuminated for display or not.

(29) According to a twenty-ninth aspect of the present invention, in the plasma display device of the twenty-eighth aspect, the plasma display panel comprises a plurality of the discharge cells, and the discharge includes a first discharge and a second discharge weaker than the first discharge, the driving unit performs the operations, as the operation for defining whether the discharge cell is illuminated for display or not, of: sequentially applying an address pulse to the first electrode of each of the plurality of discharge cells to sequentially select the plurality of discharge cells, generating the first discharge in a selected one of the plurality of discharge cells when a data pulse is applied to the second electrode of the selected discharge cell, and generating the second discharge in the selected discharge cell when the data pulse is not applied to the second electrode of the selected discharge cell.

(30) According to a thirtieth aspect of the present invention, in the plasma display device of the twenty-eighth or twenty-ninth aspect, the driving unit comprises a pulse generation unit capable of generating a voltage pulse which continuously changes from a first voltage to a second voltage, and the driving unit controls the pulse generation unit to start outputting the voltage pulse as a voltage to be applied to the first electrode, then to stop the change of the voltage pulse at the point of time when the voltage pulse reaches a third voltage between the first voltage and the second voltage and thereafter to perform the operation for defining whether the discharge cell is illuminated for display or not.

The present invention is further directed to a driving device for a plasma display panel.

(31) According to a thirty-first aspect of the present invention, the driving device for a plasma display panel comprising a discharge cell including a first electrode and a second electrode comprises the driving unit as defined in any one of the sixteenth to thirtieth aspects.

(1) In the method of the first aspect of the present invention, by setting the third voltage to various values, it is possible to easily generate a plurality of kinds of voltage pulses by one pulse generation system and apply the voltage pulses to the first electrode. This ensures reduction in cost of the plasma display device.

(2) By the method of the second aspect of the present invention, a continuous very weak discharge can be generated with the voltage pulse. Therefore, by generating the discharge irrelevant to the display emission with the voltage pulse, it is possible to improve the contrast as compared with, e.g., a case of using a rectangular voltage pulse. Further, an effect caused by the continuous very weak discharge, such as a stable generation of a constant amount of wall charges which depend on the voltage at the end of application of the voltage pulse, can be obtained and this stabilizes a (display) operation.

(3) The method of the third aspect of the present invention can produce the same effects as the method of the first or second aspect produces.

(4) By the method of the fourth aspect of the present invention, it is possible to reduce a change time by the voltage of the rectangular voltage pulse.

(5) In the method of the fifth aspect of the present invention, the application of the voltage pulse is started and stopped in a period other than the addressing period and the sustain period. Therefore, it is possible to reduce the time irrelevant to the display, such as the reset period and the erase period. Since there arises a time margin in one field by the reduction of time, by utilizing the time margin for an increase in the number of sustain pulses or subfields and the like, the luminance of light emission and the number of tones can be increased. Further, by generating the continuous very weak discharge with the voltage pulse, the discharge irrelevant to the display emission in the reset period and the like can be weaken and the contrast can be thereby improved. With these effects, the display quality can be improved.

(6) The method of the sixth aspect of the present invention can produce the same effect as the method of the fifth aspect produces. At this time, when e.g., the operation of generating a discharge in a discharge cell regardless of the display history is not performed in at least one subfield of one field, a time margin thereby arises in one field. Therefore, by utilizing the time margin for an increase in the number of sustain pulses or subfields and the like, the luminance of light emission and the number of tones can be increased to improve the display quality.

(7) By the method of the seventh aspect of the present invention, it is possible to optimize the amount of wall charges at the start of the addressing period. Further, by setting the third voltage equal to the address voltage, one circuit can be used both for generating the third voltage and for generating the address voltage and this ensures reduction in cost of the plasma display device. Furthermore, by setting the third voltage to a voltage which is obtained by subtracting the voltage of the secondary scanning pulse from the address voltage, it becomes possible to achieve the action of the secondary scanning pulse without applying the secondary scanning pulse to the second electrode in the addressing period. At this time, since no circuit for generating the secondary scanning pulse is needed, the cost of the plasma display device can be thereby reduced.

(8) By the method of the eighth aspect of the present invention, it is possible to control the state of the wall charges in the step (b) before the addressing period. Therefore, the state of the wall charges at the start of the addressing period can be optimized. Further, when the plasma display panel has a plurality of discharge cells, it is possible to suppress an abnormal discharge between adjacent discharge cells. As a result, the operations of the addressing period and the sustain period can be reliably performed and a (display) operation can be stabilized. Furthermore, since the first voltage pulse and the second voltage pulse have waveforms of which absolute values continuously increase toward a predetermined polarity, an unnecessary luminescence can be suppressed to improve the contrast as compared with the case of using the rectangular voltage pulse.

(9) By the method of the ninth aspect of the present invention, it is possible to more reliably control the state of wall charges in the step (b). Therefore, the effect of the method of the eighth aspect can be produced more pronouncedly. Further, since the respective polarities of the first to third voltage pulses alternately change, the voltage to be applied to the first electrode becomes smaller than in the case where all the first to third voltage pulses have, e.g., positive polarity. Therefore, it is possible to suppress deterioration of the phosphor layer provided in the discharge cell.

(10) In the method of the tenth aspect of the present invention, since the state of the wall charges can be uniformized regardless of the display history, it is possible to more reliably generate the wall charges in the step (a).

(11) In the method of the eleventh aspect of the present invention, the wall charges are reduced in two steps by applying the fourth voltage pulse first and subsequently applying the fifth voltage pulse. Therefore, it is possible to reduce the wall charges better than in the case of using only the fourth voltage pulse. At this time, when the plasma display panel has a plurality of discharge cells, the state of the wall charges among the plurality of discharge cells after the step (d) can be uniformized. As a result, the effect of the method of the tenth aspect can be obtained all over the plasma display panel.

(12) In the method of the twelfth aspect of the present invention, since the latter voltage pulse is applied in the period while the priming particles generated in the discharge by the former voltage pulse remain in the discharge cell, it is possible to smoothly start the discharge by the latter voltage pulse (including the very weak continuous discharge discussed below). As a result, the driving voltage margin can be enlarged. Further, the designing flexibility of the latter voltage can be enhanced when the very weak continuous discharge is generated by the latter voltage.

(13) In the method of the thirteenth aspect of the present invention, using the priming particles by the discharge in one discharge cell, the discharge in the other discharge cell can be generated more reliably. Therefore, as compared with a case where only the discharge for illuminating the discharge cell for display, for example, is generated, the above discharge for illuminating the discharge cell for display can be generated more reliably. As a result, the operation for defining whether the discharge cell is illuminated for display or not is stabilized and an image of high quality in which flicker or the like is suppressed can be obtained.

(14) In the method of the fourteenth aspect of the present invention, the discharge (the first discharge or the second discharge) is generated in the selected discharge cell, regardless of whether the data pulse is applied to the second electrode or not. In this case, since a plurality of discharge cells are sequentially selected, by using the priming particles generated by the first discharge or the second discharge in the discharge cell selected before, the first discharge or the second discharge in the discharge cell selected next can be generated more reliably. As a result, as compared with a case where the second discharge is not generated, the first discharge can be generated more reliably in the whole plasma display panel and the effect of the thirteenth aspect can be produced.

(15) In the method of the fifteenth aspect of the present invention, by setting the third voltage, the discharge can be generated in the discharge cell during the operation for defining whether the discharge cell is illuminated for display or not, regardless of whether the discharge cell is illuminated for display or not. As a result, the effects of the thirteenth or fourteenth aspect can be reliably produced.

(16) The plasma display device of the sixteenth aspect of the present invention can produce the same effect as the method of the first aspect produces.

(17) The plasma display device of the seventeenth aspect of the present invention can produce the same effect as the method of the second aspect produces.

(18) The plasma display device of the eighteenth aspect of the present invention can produce the same effect as the method of the third aspect produces.

(19) The plasma display device of the nineteenth aspect of the present invention can produce the same effect as the method of the fourth aspect produces.

(20) The plasma display device of the twentieth aspect of the present invention can produce the same effect as the method of the fifth aspect produces.

(21) The plasma display device of the twenty-first aspect of the present invention can produce the same effect as the method of the sixth aspect produces.

(22) The plasma display device of the twenty-second aspect of the present invention can produce the same effect as the method of the seventh aspect produces.

(23) The plasma display device of the twenty-third aspect of the present invention can produce the same effect as the method of the eighth aspect produces.

(24) The plasma display device of the twenty-fourth aspect of the present invention can produce the same effect as the method of the ninth aspect produces.

(25) The plasma display device of the twenty-fifth aspect of the present invention can produce the same effect as the method of the tenth aspect produces.

(26) The plasma display device of the twenty-sixth aspect of the present invention can produce the same effect as the method of the eleventh aspect produces.

(27) The plasma display device of the twenty-seventh aspect of the present invention can produce the same effect as the method of the twelfth aspect produces.

(28) The plasma display device of the twenty-eighth aspect of the present invention can produce the same effect as the method of the thirteenth aspect produces.

(29) The plasma display device of the twenty-ninth aspect of the present invention can produce the same effect as the method of the fourteenth aspect produces.

(30) The plasma display device of the thirtieth aspect of the present invention can produce the same effect as the method of the fifteenth aspect produces.

(31) By the driving device of the thirty-first aspect of the present invention, it is possible to provide an driving device for plasma display panel which can produce any one of the effects of the sixteenth to thirtieth aspects.

A first object of the present invention is to provide a method of driving a plasma display panel, which makes it possible to generate a plurality of kinds of voltage pulses by using one pulse generation system.

A second object of the present invention is to provide a method of driving a plasma display panel, which ensures stabilization of a (display) operation and/or improvement in display quality, as well as achieves the first object.

A third object of the present invention is to provide a method of driving a plasma display panel, which achieves the first and second objects at low cost.

A fourth object of the present invention is to provide a plasma display device and a driving device for plasma display panel which achieve the first to third objects.

These and other objects, features, aspects and advantages of the present invention will become more apparent from the following detailed description of the present invention when taken in conjunction with the accompanying drawings.

DESCRIPTION OF THE PREFERRED EMBODIMENTS

<The First Preferred Embodiment>

(Constitution of Plasma Display Device)

Figure 1:
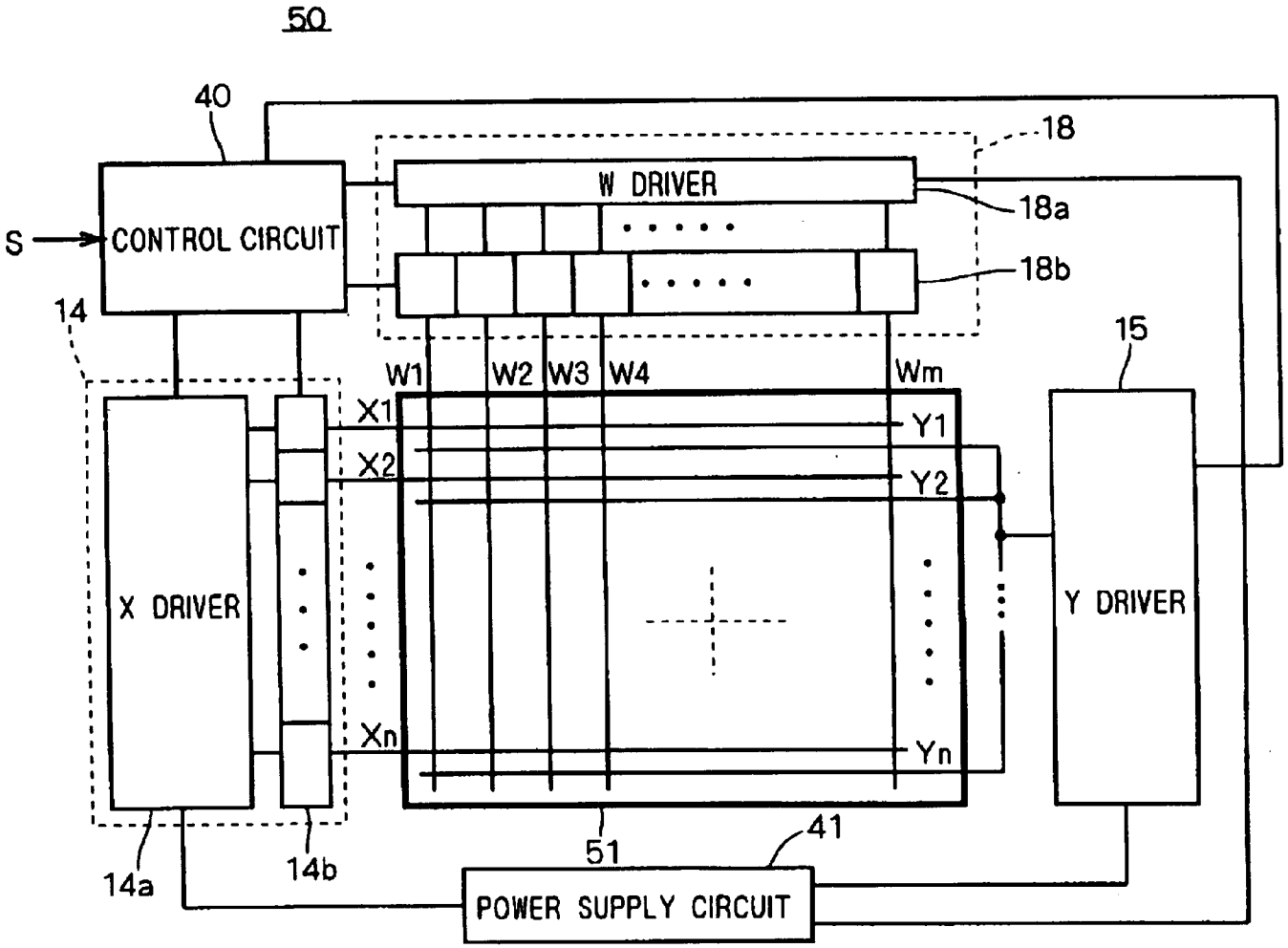
FIG. 1 is a block diagram showing an overall structure of a plasma display device in accordance with a first preferred embodiment of the present invention.

FIG. 1 is a block diagram showing an overall structure of a plasma display device 50 in accordance with the first preferred embodiment. The plasma display device 50 comprises a PDP 51, driving devices 14, 15 and 18, a control circuit 40 and a power supply circuit 41 for supplying various voltages for the driving devices 14, 15 and 18.

The driving device 18 includes a W driver 18*a* and a driving IC 18*b*, and the driving IC 18*b* is driven by the W driver 18*a*. The driving device 14 includes an X driver (driving unit) 14*a* like the W driver 18*a* and a driving IC 14*b*, and the driving IC 14*b* is driven by the X driver 14*a*. The driving device 15 includes a Y driver like the W driver 18*a*. The control circuit 40 controls the driving devices 14, 15 and 18 in response to a video signal. The driving devices 14 and 15 are each constituted of a switch element such as a field effect transistor (FET) and other circuit components.

As the PDP 51, applicable are various PDPs each comprises discharge cells. Each of the discharge cells includes a first electrode and a second electrode, capable of controlling generation/non-generation of discharge by potential difference between the first electrode and the second electrode. Herein, discussion will be made on a case where the background-art PDP 101 is used as the PDP 51, and the row electrode X corresponds to the first electrode and the row electrode Y corresponds to the second electrode. As discussed earlier, the electrode X and the electrode Y may be each constituted of a transparent electrode and a metal electrode, or may be each made of only a metal electrode. Further, in FIG. 1, only n row electrodes X1 to Xn, n row electrodes Y1 to Yn, m column electrode W1 to Wm among constituent elements of the PDP 51 are schematically shown. Further, in the following discussion, attention will be mainly paid to one discharge cell.

(Round Pulse Generation Circuit)

Figure 2:
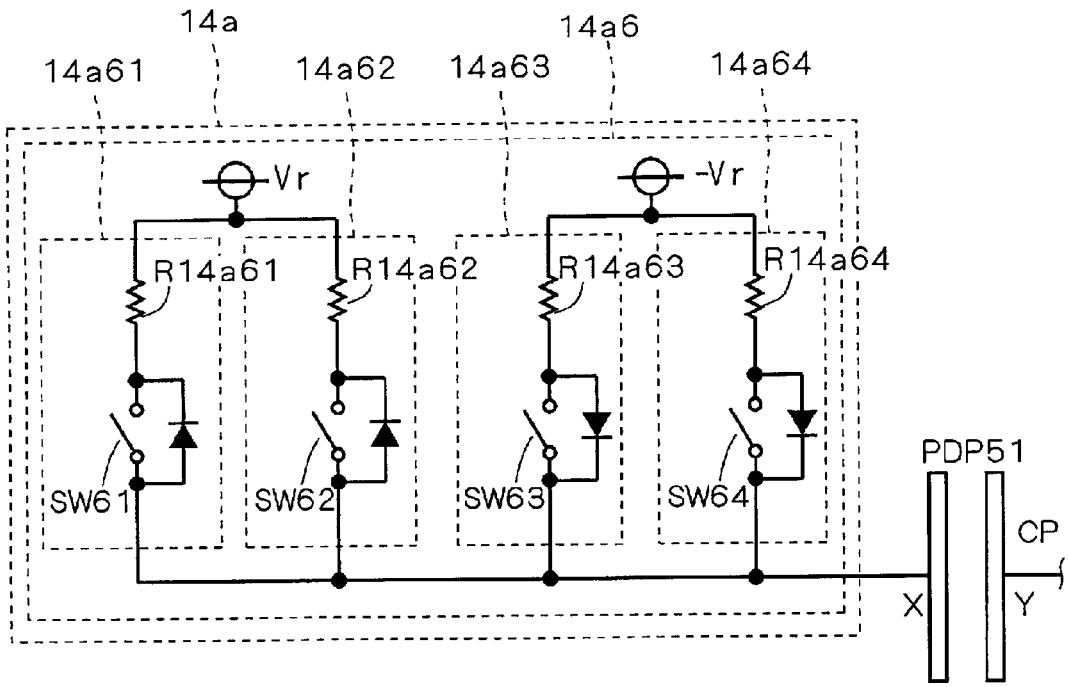
FIG. 2 is a circuit diagram showing a round pulse generation circuit in accordance with the first preferred embodiment of the present invention.

FIG. 2 is a circuit diagram showing the X driver 14*a*. Further, in FIG. 2, only constituent elements necessary for the following discussion are shown and the X driver 14*a* includes various circuits such as a circuit for generating and outputting a rectangular voltage pulse which is used as a sustain pulse. Furthermore, in FIG. 2, the PDP 51 is represented as a capacitance element CP.

As shown in FIG. 2, the X driver 14*a* includes a round pulse generation circuit (pulse generation unit) 14*a*6. Further, in the discussion of the first preferred embodiment and the following preferred embodiments, the round (voltage) pulse refers to a voltage pulse which continuously changes from a first voltage to a second voltage, unlike the rectangular (voltage) pulse. In more detail, the round (voltage) pulse refers to a voltage pulse which reaches the final voltage (which corresponds to the second voltage) after a time longer than the discharge delay time passes from the point of time when it exceeds the firing voltage. Specifically, the round (voltage) pulse includes the CR (voltage) pulse, the ramp (voltage) pulse and an LC resonant (voltage) pulse discussed later.

The round pulse generation circuit 14*a*6 includes four unit circuits 14*a*61 to 14*a*64 having the same constitution. For example, the unit circuit 14*a*61 is made of a series circuit consisting of a resistor R14*a*61 and a switch element SW61, and similarly the unit circuits 14*a*62 to 14*a*64 are made of series circuits consisting of resistors R14*a*62 to R14*a*64 like the resistor R14*a*61 and switch elements SW62 to SW64 like the switch element SW61, respectively. In this case, for example, it is set that (resistance value R14*a*61)>(resistance value R14*a*62) and (resistance value R14*a*63)>(resistance value R14*a*64). Further, as each of the switch elements SW61 to SW64, a switch element such as a field effect transistor (FET), a bipolar transistor and an IGBT (Insulated Gate Bipolar Transistor) can be used, and each switch element is represented by a switch and a body diode in FIG. 2 and the like.

The unit circuits 14*a*61 and 14*a*62 are connected in parallel, for example, between a power supply for outputting a (final) voltage Vr and one electrode (which corresponds to electrode X) of the capacitance element CP. On the other hand, the unit circuits 14*a*63 and 14*a*64 are connected in parallel, for example, between a power supply for outputting a (final) voltage (−Vr) and the aforementioned one electrode of the capacitance element CP.

The round pulse generation circuit 14*a*6 can generate three kinds of basic pulses as a CR pulse having the final voltage Vr. Specifically, by turning only the switch element SW61 on, a CR pulse having a time constant $\tau$61=CP×R14*a*61 can be generated, and by turning only the switch element SW62 on, a CR pulse having a time constant $\tau$62=CP×R14*a*62 can be generated. Further, by turning only the switch elements SW61 and SW62 on, a CR pulse having a time constant $\tau$612=CP×R14*a*612 can be generated, where the resistance value R14*a*612=R14*a*61×R14*a*62/(R14*a*61+R14*a*62). In this case, since (resistance value R14*a*61)>

(resistance value R14*a*62), the relation τ612>τ61>τ62 holds. Similarly, the round pulse generation circuit 14*a*6 can generate three kinds of basic pulses as a CR pulse having the final voltage (−Vr).

Figure 3:
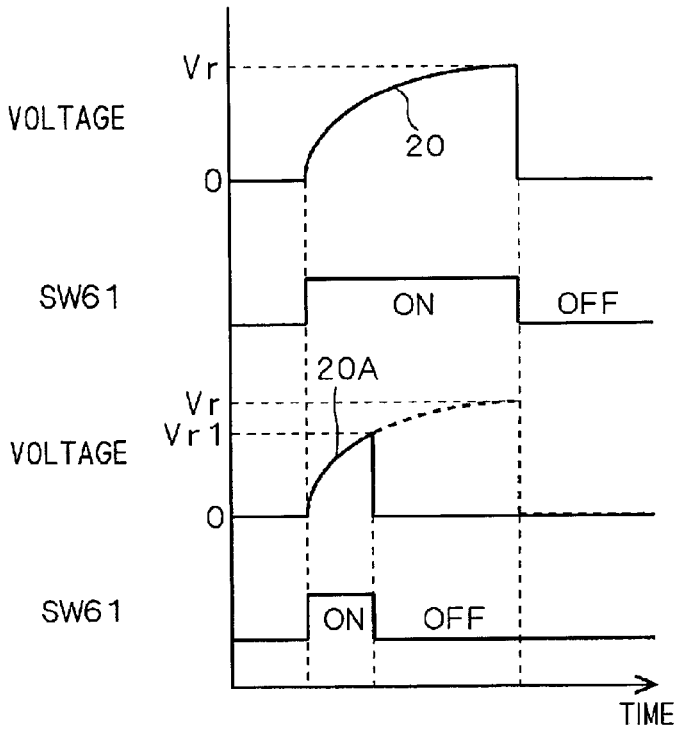
FIG. 3 is a timing chart used for explaining an operation of the round pulse generation circuit in accordance with the first preferred embodiment of the present invention.

Further, the round pulse generation circuit 14*a*6 can generate more kinds of pulses by using the above basic CR pulses. This will be discussed, referring to FIG. 3. FIG. 3 is a timing chart used for explaining an operation of the round pulse generation circuit 14*a*6. Herein, discussion will be made, taking the CR pulse having the time constant τ61 as an example.

As discussed above, when the switch element SW61 is turned on, a CR pulse 20 which continuously changes from the ground potential (the first voltage) to the final voltage (the second voltage) Vr can be generated. In the round pulse generation circuit 14*a*6, particularly, by turning the switch element SW61 off before the voltage reaches the final voltage Vr, as shown in FIG. 3, an increase (change) of the voltage or the voltage pulse is stopped. This makes it possible to obtain the a CR pulse 20A having the time constant τ61 and a predetermined output voltage (a third voltage) Vr1 (<Vr).

Specifically, the X driver 14*a* controls the switch element SW61 of the round pulse generation circuit 14*a*6, in other words, uses a pulse generation system for generating the CR pulse 20, to generate the CR pulse 20A. In particular, the voltage Vr1 is set to a voltage value on the side of the voltage Vr relative to the firing voltage and the resistor R14*a*61 and the like are set so that the voltage of the CR pulse 20A may reach the voltage Vr1 after a time longer than the discharge delay time passes from the point of time when it exceeds the firing voltage.

With the round pulse generation circuit 14*a*6 or the CR pulse 20A, it is possible to easily generate various CR pulses by using the circuit or pulse generation system for generating the basic CR pulse 20, depending on the setting of the voltage Vr1. Therefore, since it is not necessary to provide the generation circuits as many as the kinds of CR pulses, the cost of the plasma display device 50 can be reduced.

Further, with the CR pulse 20A, since application of the CR pulse 20A itself is stopped (or the CR pulse 20A falls) at the point of time when the voltage reaches the voltage Vr1, in other words, after the discharge is started, no unnecessary time is spent after the start of discharge. Therefore, by using the CR pulse 20A in, e.g., the reset period and the erase period (both of which are irrelevant to the display emission or display discharge) (as discussed later), it is possible to reduce the reset period and the like. A time margin is obtained in one field by the reduction, and by using the time margin for an increase in the number of sustain pulses or subfields, the luminance of light emission and the number of tones can be increased to improve the display quality.

Furthermore, depending on the settings of the voltage Vr1 and the time when the voltage reaches the voltage Vr1, it is possible to generate a continuous very weak discharge also with the CR pulse 20A. Therefore, by generating the discharge irrelevant to the display emission with the CR pulse 20A, it is possible to improve the contrast as compared with, e.g., the case of using the rectangular voltage pulse. Further, an effect caused by the continuous very weak discharge, such as a stable generation of a constant amount of wall charges which depend on the voltage at the end of application of the voltage pulse, can be obtained with the CR pulse 20A and it thereby becomes possible to stabilize a (display) operation.

Figure 4:
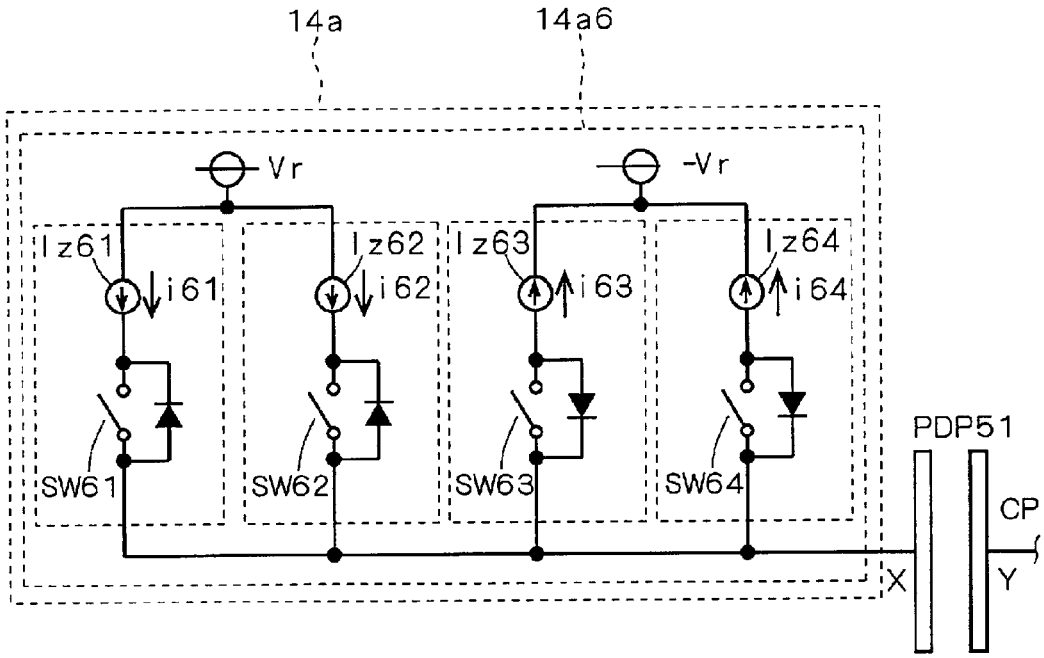
FIG. 4 is a circuit diagram showing another round pulse generation circuit in accordance with the first preferred embodiment of the present invention.

Furthermore, when the ramp pulse is generated, as shown in the schematic view of FIG. 4, constant current elements Iz61 to Iz64 for outputting constant currents i61 to i64, respectively, have to be provided, instead of the resistors R14*a*61 to R14*a*64 of FIG. 2. In this case, the constant current elements Iz61 to Iz64 have to be set so that the currents i61 and i62 may flow toward the switch elements SW61 and SW62 and the currents i63 and i64 may flow toward the power supply, respectively.

(Method of Driving Plasma Display Panel)

Figure 5:
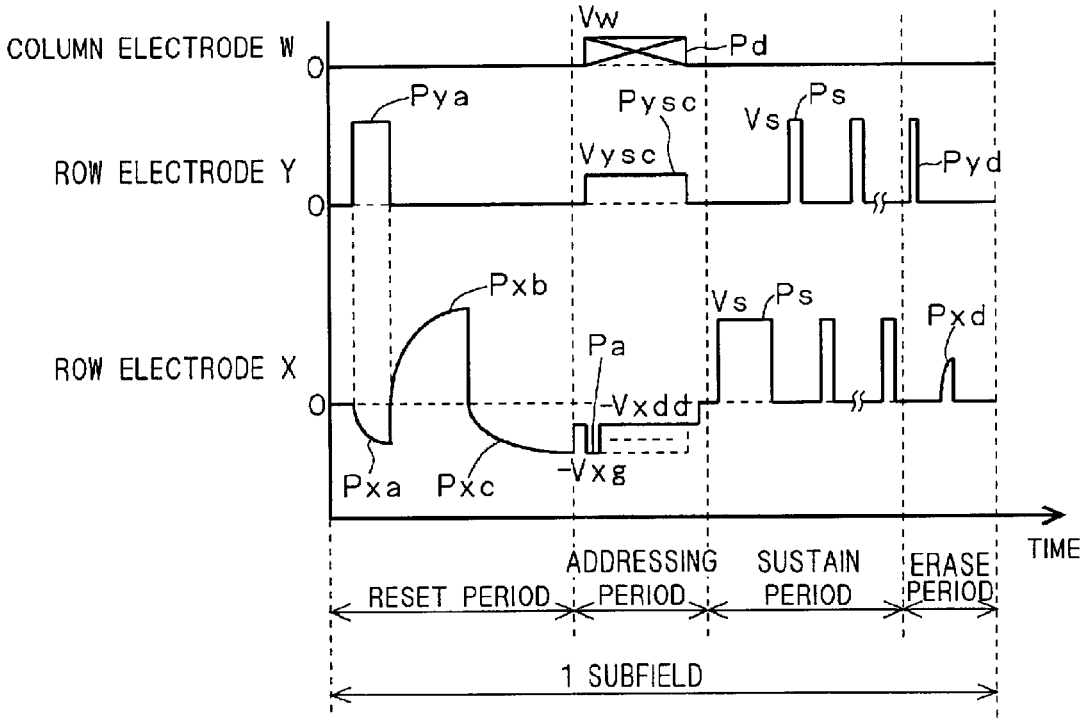
FIG. 5 is a timing chart used for explaining a method of driving a plasma display panel in accordance with the first preferred embodiment of the present invention.

FIG. 5 is a timing chart used for explaining a method of driving a PDP 51 in the plasma display device 50. FIG. 5 shows a driving method in one subfield. A plurality of subfields which are different in the number of applications of the sustain pulses Ps from one another constitute one field. As shown in FIG. 5, one subfield is divided into four periods, i.e., the reset period, the addressing period, the sustain period and the erase period.

(Reset Period)

In the reset period, a full lighting pulse consisting of a pulse (a first voltage pulse) Pxa and a pulse Pya, a full erase pulse (a third voltage pulse) Pxb and a potential control pulse (a second voltage pulse) Pxc are applied. As the pulses Pxa, Pxb and Pxc, round pulses (herein, CR pulses) are used. Though the pulses Pxa, Pxb and Pxc are common in that the respective absolute values of voltages thereof continuously increase toward a predetermined polarity, the pulses Pxa, Pxb and Pxc have different functions. The driving method in the reset period will be discussed in detail below.

(Full Lighting Pulse)

First, the rectangular pulse Pya of positive polarity is applied to all the electrodes Y while the round pulse Pxa of negative polarity is applied to all the electrodes X. Specifically, a voltage pulse in which the round pulse Pxa is superimposed on the rectangular pulse Pya is applied between a pair of electrodes X and Y. Further, in this case, the Y driver 15 for outputting a rectangular pulse and the X driver 14*a* generally correspond to "the driving unit". With the full lighting pulse, a discharge is generated in all the discharge cells regardless of the display history to generate wall charges (a first step). At this time, the polarity of the round pulse Pxa is set equal to that of an address (voltage) pulse (also referred to as scanning pulse) Pa to be applied to the electrode X in the addressing period discussed later (herein, negative polarity).

At this time, the voltage of the rectangular pulse Pya is set to such a voltage as not to start a discharge by itself, in other words, when not being accompanied by the round pulse Pxa. Herein, the voltage of the rectangular pulse Pya can be set almost equal to the sustain voltage Vs. This is because no discharge is started even if the voltage almost equal to the sustain voltage Vs is applied as the rectangular pulse Pya since the wall charges are reduced or erased in advance before the full lighting pulse consisting of the pulses Pxa and Pya is applied, specifically, in the erase period discussed later in the present driving method.

On the other hand, the voltage of the round pulse Pxa is set so that the potential difference between the pulses Pya and Pxa may exceed the firing voltage Vf by applying the round pulse Pxa concurrently with the rectangular pulse Pya. The voltage of the round pulse Pxa will be discussed in detail later. Such a setting of the voltages of the pulses Pya and Pxa allows generation of the discharge all over the PDP 51.

(Full Erase Pulse)

Subsequent to the full lighting pulse, a round pulse having a polarity reverse to that of the round pulse Pxa is applied to the electrodes X as the full erase pulse Pxb. With this round pulse Pxb, an erase operation is performed all over the PDP 51 (a third step). This erase operation is performed to reverse the polarity of the wall charges accumulated by the full lighting operation for effective execution of a subsequent potential control operation (discussed later), not to make the amount of wall charges zero.

At this time, the final potential Vxb of the round pulse Pxb is set to be higher than that of a pulse for only erasing. Specifically, though the final voltage of the round pulse may be usually almost equal to the sustain voltage Vs for the purpose of only erasing, the final voltage Vxb of the round pulse Pxb is set to be slightly higher than the sustain voltage Vs (by about 10 to 70 V).

Figure 6:
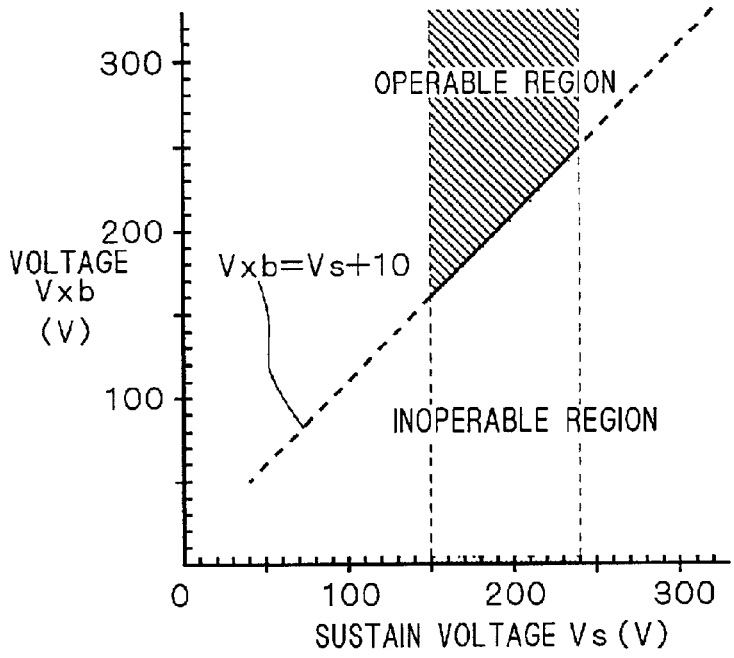
FIGS. 6 and 7 are graphs used for explaining conditions for driving the plasma display panel in accordance with the first preferred embodiment of the present invention.

FIG. 6 is a graph used for explaining a driving condition caused by the round pulse Pxb. The horizontal axis of this graph indicates the sustain voltage Vs and the vertical axis indicates the final voltage Vxb of the round pulse Pxb. As shown in FIG. 6, the relation between the voltage Vxb and the sustain voltage Vs is divided into two regions, i.e., an operable region and an inoperable region with a line indicating (the final voltage Vxb)={(the sustain voltage Vs)+10 (V)} as a boundary. In more detail, when the voltage Vxb is set to be not higher than {(the sustain voltage Vs)+10 (V)}, a non-selected cell is illuminated in the subsequent addressing period and sustain period and the display quality is thereby deteriorated (in the inoperable region). Therefore, in the present driving method, the final voltage Vxb of the round pulse Pxb is set to not lower than {(the sustain voltage Vs)+10(V)}.

(Potential Control Pulse)

After application of the round pulse Pxb, the potential control pulse Pxc for potential control is applied to all the electrodes X to generate a discharge and the state of the wall charges in the discharge cells is controlled by this discharge (a second step), to generate an optimal amount of wall charges for the subsequent addressing discharge. As discussed above, since the round pulse can generate the wall charges which depend on the potential at the end of application, the amount of wall charges before the addressing discharge is controlled by using the round pulse as the potential control pulse Pxc in the present driving method. Further, the polarity of the round pulse Pxc is set to the same one as that of the round pulse Pxa and the address pulse Pa, in other words, a polarity reverse to that of the round pulse Pxb.

In the present driving method, particularly, the final potential Vxc of the round pulse Pxc is set to the same value as that of the voltage (address voltage) of the address pulse Pa In other words, the final potential Vxc of the round pulse Pxc is set to a negative potential (−Vxg) relative to a reference potential (0 V) of the electrode W. With such a setting of the voltage, one power supply can be used as that for the address pulse Pa and that for the potential control pulse Pxc. Further, it is possible to stabilize the operation of the PDP 51. This stabilization of operation will be discussed in detail below.

First, with the above setting of the voltage, even if the value of the voltage Vxg changes, in response to this change, the final voltage Vxc of the round pulse Pxc can be changed into the voltage Vxg. Therefore, regardless of the value of the voltage Vxg, it is possible to always optimize the amount of wall charges or wall voltage. This will be discussed below, taking a specific example.

Figure 28:
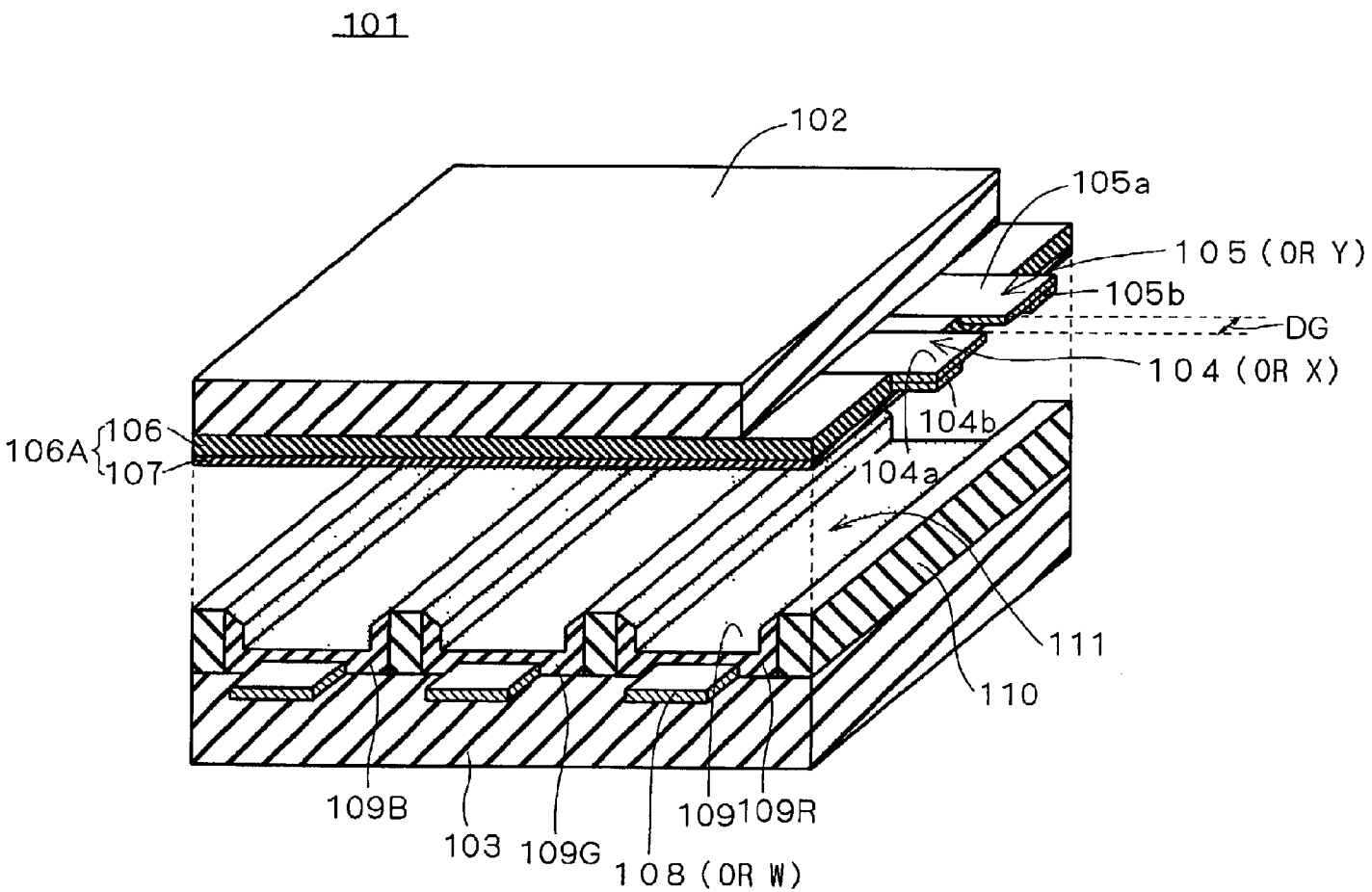
FIG. 28 is a perspective view showing a structure of a plasma display panel in the background art.

When the firing voltage Vf in the discharge gap DG (see FIG. 28) between the electrodes X and Y is 110 V, for example, a discharge is started when the voltage Vxc of the potential control pulse Pxc reaches −110 V. After that, the voltage across the discharge gap DG is kept at −110 V. Further, since the relation (voltage across the discharge gap DG)=(externally-applied voltage)+(wall voltage), i.e., (wall voltage)=(voltage across the discharge gap DG)−(externally-applied voltage) holds, a wall voltage of (−110 (V)−Vxg) is applied to the discharge gap DG when the final voltage Vxc of the potential control pulse Pxc reaches the voltage Vxg.

When the voltage Vxg is −150 (V), a wall voltage of 40 V is applied across the discharge gap DG after the application of the potential control pulse Pxc. Specifically, wall charges corresponding to +20 V are accumulated on the electrode X and wall charges corresponding to −20 V are accumulated on the electrode Y.

At this time, if a voltage Vysc of 30 V, for example, is applied to the electrode Y as a secondary scanning pulse Pysc in the subsequent addressing period, a voltage of {(Vxg−Vysc)+(wall voltage)}=−150 (V)−30 (V)+40 (V)=−140 (V) is applied between the electrodes X and Y.

Next, a case where the voltage Vxg is changed into −180 (V) will be considered. In this case, after the application of the potential control pulse Pxc, a wall voltage of 70 V is applied across the discharge gap DG. Specifically, wall charges corresponding to +35 V are accumulated on the electrode X and wall charges corresponding to −35 V are accumulated on the electrode Y. At this time, if the voltage Vysc of the secondary scanning pulse Pysc is 30 V, a voltage of (−180 V−30 V+70 V)=−140 (V) is applied between the electrodes X and Y in the addressing period.

Thus, both when the voltage Vxg is −150 (V) and when the voltage Vxg is −180 (V), the voltage of −140 (V) is applied between the electrodes X and Y in the addressing period. Specifically, regardless of the value of the voltage Vxg, a constant voltage is applied across the discharge gap DG in the addressing period. Therefore, even if the voltage Vxg changes for some reasons, it is possible to stably (optimally) drive the PDP 51.

Next, a case where the firing voltage Vf across the discharge gap DG is changed by only 10 V into 120 V will be considered. This corresponds to a case where a discharge of 10 V becomes hard to generate for some reasons. Further, the voltage Vxg remains −150 V.

At this time, the wall voltage becomes {−120 V−(−150 V)}=30 (V). Therefore, a voltage of (−150 V−30 V+30 V)=−150 (V) is applied across the discharge gap DG in the addressing period. This voltage value is higher than that in the case where the firing voltage Vf=110 V by 10 V in absolute value. In other words, in response to the rise of the firing voltage Vf by 10 V, the voltage applied across the discharge gap DG becomes higher by voltage ΔV.

Similarly, when the firing voltage Vf changes by voltage change ΔV, in response to this change, the voltage applied to the discharge gap DG automatically changes by the voltage change ΔV. In short, even if the firing voltage Vf changes for some reasons, the voltage applied to the discharge gap DG is always kept to a constant value or an optimal value in response to the change.

Thus, even if the firing voltage Vf changes with time or the firing voltage varies among each discharge cell, for example, the voltage applied to the discharge gaps DG in the addressing period can be automatically controlled. This enlarges the driving voltage margin, thereby ensuring a stable operation. Further, since it is possible to respond the change with time, the lifetime of the PDP 51 can become longer.

(Addressing Period and Sustain Period)

After that, in the addressing period, whether the respective discharge cells should be illuminated or not in the subsequent sustain period is determined. In the sustain period, light emission is generated in discharge cell(s) determined in the addressing period to be illuminated.

In more detail, in the addressing period, the secondary scanning pulse Pysc having the voltage Vysc is applied to all the electrodes Y and the following voltage is applied to the electrodes X. Specifically, a bias voltage (−Vxdd) is first applied to all the electrodes X and then in accordance with the scanning of the electrodes X, the scanning pulse (address pulse) Pa having the voltage (address voltage) Vxg is applied to scanned (selected) electrodes X. At this time, in accordance with the scanning of the electrodes X, a data pulse Pd having a voltage Vw is applied to a predetermined electrode(s) W according to display information or image data.

With this operation, in a predetermined discharge cell based on the display information, an addressing discharge is generated between the electrodes X and W. This discharge immediately extends to between the electrodes X and Y to generate and accumulate wall charges between the electrodes X and Y.

In the sustain period subsequent to the addressing period, the sustain pulse Ps having the voltage Vs is applied alternately to the electrode X and electrode Y. With this operation, a sustain discharge is generated only in the discharge cell(s) in which the addressing discharge is generated in the preceding addressing period. The sustain discharge is repeated a predetermined number of times defined for the subfield.

(Erase Period)

After the sustain period is ended, the erase period is started. In the erase period, the wall charges in the discharge cell(s) (illuminated cell(s)) in which the sustain discharge is generated in the preceding sustain period are reduced or erased (a fourth step). With this operation, the state of the wall charges in the illuminated cell(s) is made the same as that in the discharge cell(s) (not illuminated cell(s)) in which no sustain discharge is generated in the preceding sustain period. Specifically, in the erase period, the state of the wall charges are made almost uniform all the discharge cells of the PDP 51. With this uniformization, the operation in the reset period of the subsequent subfield can be reliably performed on all the discharge cells under a constant or the same condition.

Specifically, in the erase period, fourth a pulse (a fourth voltage pulse) Pyd having the sustain voltage Vs and a pulse width slightly narrower than that of the sustain pulse Ps is applied to all the electrodes Y, and then a round pulse (a fifth voltage pulse; herein a CR pulse) Pxd is applied to all the electrodes X. With this two pulses, the wall charges are gradually reduced in two steps to uniformize the state of the wall charges.

(Pulse Pyd)

As the pulse Pyd used is a voltage pulse which can generate a discharge at its rise and fall. Herein, the width of the pulse Pyd is set so that a self-erase discharge can be generated at the fall of the pulse Pyd. The discharge at the fall is generated by utilizing the drop of the firing voltage Vf by space charges generated in the discharge at the rise of the pulse. More specifically, after a discharge current produced by the discharge at the rise of the pulse Pyd completely flows, the pulse Pyd is quickly lowered, and the discharge (self-erase discharge) is generated again at the fall by the wall charges accumulated in the discharge at the rise and the space charges.

When the width of the pulse Pyd is too narrow, the self-erase discharge becomes too strong and after that, no discharge can be generated with the round pulse Pxd. If the erase operation is performed only with the pulse having narrow width, when there is variation in discharge delay time among the discharge cells, for example, there arises remarkable variation among the discharge cells in the amount of wall charges left after the discharge. This causes problems such as unstabilization of the following operation.

Conversely, when the width of the pulse Pyd is too wide, no self-erase discharge is generated and the wall charges can not be reduced. If the round pulse Pxd is applied in the state where a lot of wall charges are left, a discharge is started with a relatively low voltage. In the case of the CR pulse, since the rate of voltage change dv/dt becomes larger as the voltage is low, a stronger discharge is generated. In other words, it is impossible to take full advantage of the characteristic feature of the round pulse.

Figure 7:
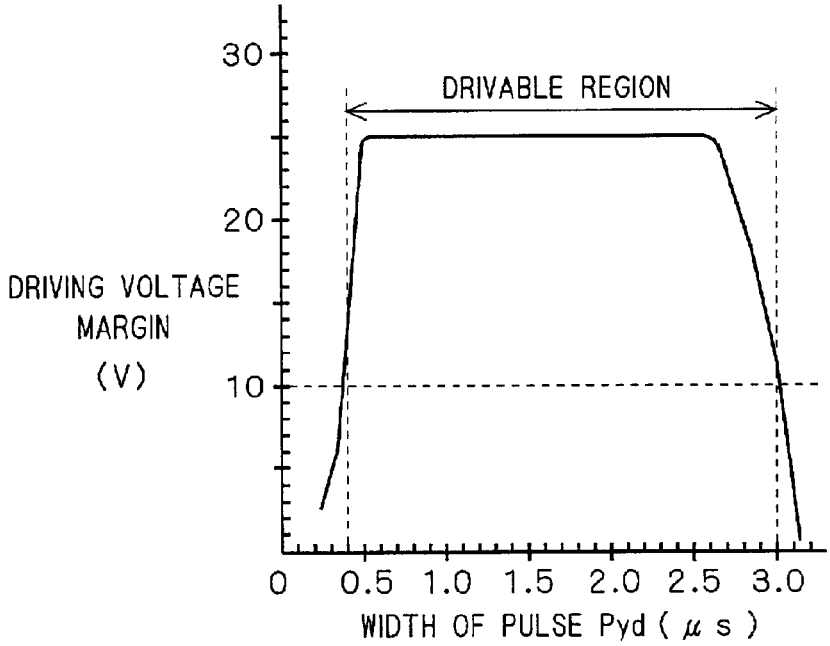

FIG. 7 is a graph used for explaining the relation between the width of the pulse Pyd and the driving voltage margin. The driving voltage margin refers to such a voltage width as to normally perform an operation when the sustain voltage Vs and the voltage Vxg of the address pulse Pa are changed at the same time.

FIG. 7 shows that a stable driving voltage margin not lower than 10 V can be obtained by setting the width of the pulse Pyd to 0.4 $\mu$s to 3.0 $\mu$s. Considering this, the width of the pulse Pyd is set in a range from 0.4 $\mu$s to 3.0 $\mu$s in the present driving method.

(Round Pulse Pxd)

When the wall charges are reduced by the pulse Pyd, the firing voltage Vf for the subsequent round pulse Pxd becomes higher than that for the pulse Pyd. Therefore, since the discharge can be started in a region where the rate of voltage change dv/dt of the round pulse (CR pulse) Pxd is gentle, it is possible to reduce the wall charge well with the round pulse Pxd.

The round pulse Pxd is applied in order to further reduce the wall charges after the application of the pulse Pyd and make the state of the wall charges more uniform. Therefore, it is not necessary to apply a high voltage as the round pulse Pxd but only necessary to apply a voltage having such a value as to generate a discharge again only in the discharge cell(s) in which the discharge is generated with the pulse Pyd.

When the final voltage of the round pulse Pxd is too high, for example, since more wall charges than necessary are generated and accumulated, the discharge is started early when the round pulse Pxa is applied in the reset period of the subsequent subfield. Since the rate of voltage change dv/dt is large in the early part of rise of round pulse or the CR pulse Pxa, a strong luminescence sometimes occurs. Further, variation in discharge characteristics among the discharge cells is not absorbed, and as a result, the driving voltage margin is sometimes lowered. Therefore, in the present driving method, the final voltage of the round pulse Pxd is set almost equal to the sustain voltage Vs or lower.

Through the above series of operations or steps, driving of one subfield is completed. Further, the erase period may be set in the first stage of the subfield, in other words, before the reset period.

Though both the pulse Pxa and the potential control pulse Pxc are similar round pulses of negative polarity, the optimal values for the final voltages of the pulses Pxa and Pxc are different from each other because the roles of the pulses Pxa and Pxc are different from each other.

Specifically, the pulse Pxa has only to be set to such a minimum voltage as to generate a discharge in all the discharge cells of the PDP 51 by the potential difference (|Pxa|+|Pya|) between the pulse Pxa and the pulse Pya and does not need to be set to a voltage higher than that. The reason is as follows. Specifically, the luminescence by (the full lighting pulse including) the pulse Pxa is irrelevant to the display and deteriorates the contrast of image. Since the intensity of luminescence depends on the final voltage of the full lighting pulse, deterioration in contrast becomes pronounced when the pulse Pxa is set to a voltage higher than necessary.

In contrast to this, the potential control pulse Pxc is set to the same potential as the voltage −Vxg of the address pulse Pa (or a voltage obtained by subtracting the voltage Vysc of the secondary scanning pulse Pysc from the voltage −Vxg as discussed later in the second preferred embodiment).

In the present driving method, the pulses Pxa and Pxc are generated by the round pulse generation circuit **14*a*6** in the following manner. Specifically, a pulse having a lower final voltage in absolute value is generated by cutting off a pulse having a higher final voltage in absolute value before its voltage reaches the final voltage. In more detail, the potential control pulse Pxc (or a round pulse having the same time constant or inclination as the pulse Pxc has) is applied and before the voltage reaches the final voltage of the pulse Pxc, e.g., at the point of time when it reaches about a third to two thirds of the final voltage of the pulse Pxc, the application of the pulse Pxc is stopped to lower the pulse Pxc into the ground potential (0 V).

Similarly, it is also possible to generate the pulse Pxd by using a pulse generation circuit for the full erase pulse Pxb. Specifically, both the full erase pulse Pxb and the pulse Pxd are round pulses of positive polarity, and further, as discussed above, the pulse Pxb is set to be higher than the sustain voltage Vs by about 10 V and the pulse Pxd is set almost equal to the sustain voltage Vs or lower. Therefore, the pulse Pxd can be generated by applying the pulse Pxb and lowering it before the voltage reaches the final voltage of the pulse Pxb.

The present driving method can produce the following effects.

First, it is possible to generate both the pulses Pxa and Pxc by using only the pulse generation circuit for the pulse Pxc. This simplifies the constitution of the driving device in the plasma display device 50 and reduces the manufacturing cost thereof. Moreover, with such a simple control as to stop application of the pulse at a predetermined timing, a desired pulse can be easily generated.

Further, since the full lighting pulse is a pulse in which the round pulse Pxa which is obtained by stopping its application on the way of rise is superimposed on the rectangular pulse Pya having the voltage Vs, the following effects can be produced.

(i) It is possible to reduce the application time of the pulse.

With only the CR pulse, it takes a long time for the voltage to approximate the final voltage after it rises to some degree. In contrast to this, since the full lighting pulse in the present driving method is a pulse in which the CR pulse Pxa which sharply rises is superimposed on the rectangular pulse Pya, a quick rise up to a voltage not higher than the firing voltage Vf can be achieved.

In particular, the round pulse Pxa is lowered at the point of time when the voltage reaches such a voltage as to generate a discharge all over the PDP 51 (at the same time, the rectangular pulse Pya is also lowered). Specifically, before the voltage finally reaches a predetermined voltage, application of the voltage is stopped. Therefore, since the voltage is not applied for a longer time than necessary after the start of discharge, the application time of the full lighting pulse can be significantly reduced. Further, also by applying the superimposed voltage pulse to the electrode X or the electrode Y, the same effect can be produced (in this case, the X driver **14*a* or the Y driver 15** corresponds to "the driving unit").

(ii) It is possible to reduce the rate of voltage change dv/dt near the firing voltage Vf because of the round pulse Pxa. With this reduction, a continuous very weak discharge in which the characteristic feature of the round pulse lies can be generated.

Therefore, an effect caused by the continuous very weak discharge, such as a stable generation of a constant amount of wall charges which depend on the voltage at the end of application of the voltage pulse can be produced. As a result, the (display) operation can be stabilized.

(iii) With the round pulse Pxa, the full lighting discharge irrelevant to the display emission can be weaken. For this reason, an unnecessary light emission can be suppressed. In particular, since the full lighting pulse is not applied for a longer time necessary as discussed above, the above unnecessary discharge can be suppressed to a minimum. Therefore, it is possible to improve the contrast of display image.

Figure 30:
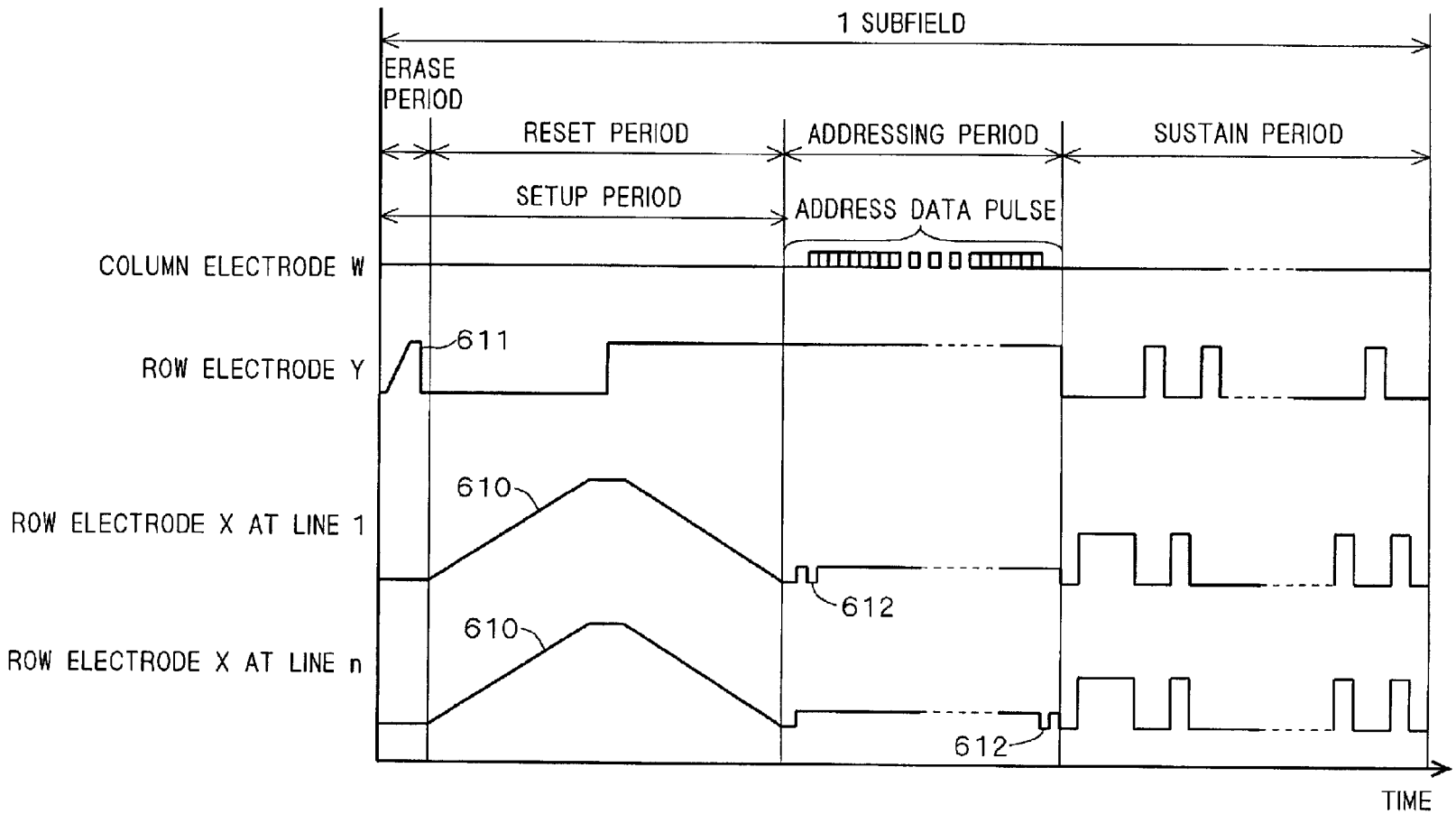
FIG. 30 is a timing chart used for explaining a second background-art method of driving a plasma display panel.
Figure 31:
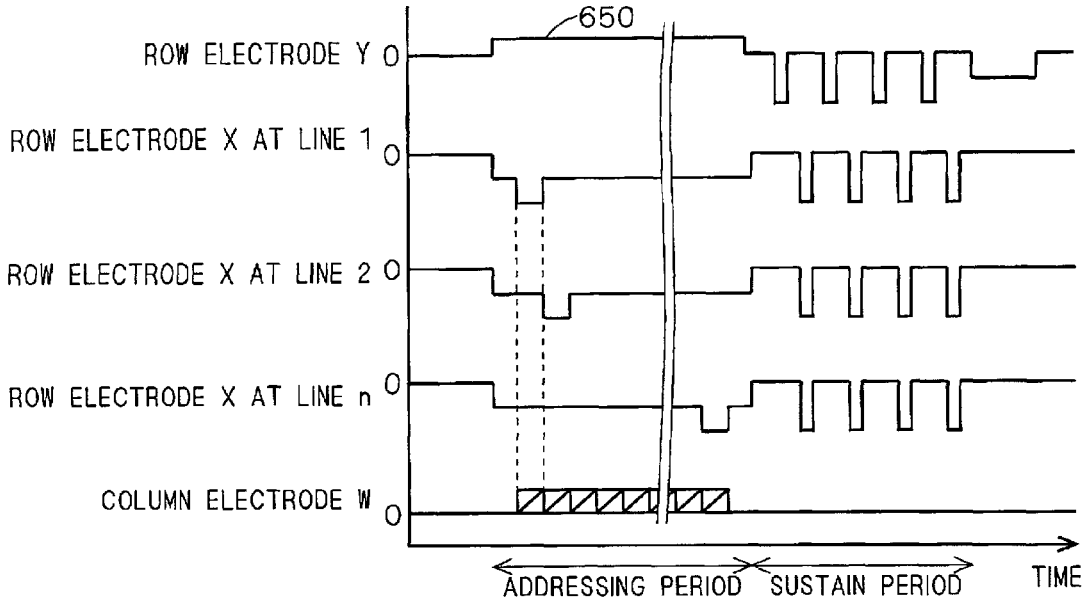
FIG. 31 is a timing chart used for explaining a third background-art method of driving a plasma display panel.
Figure 32:
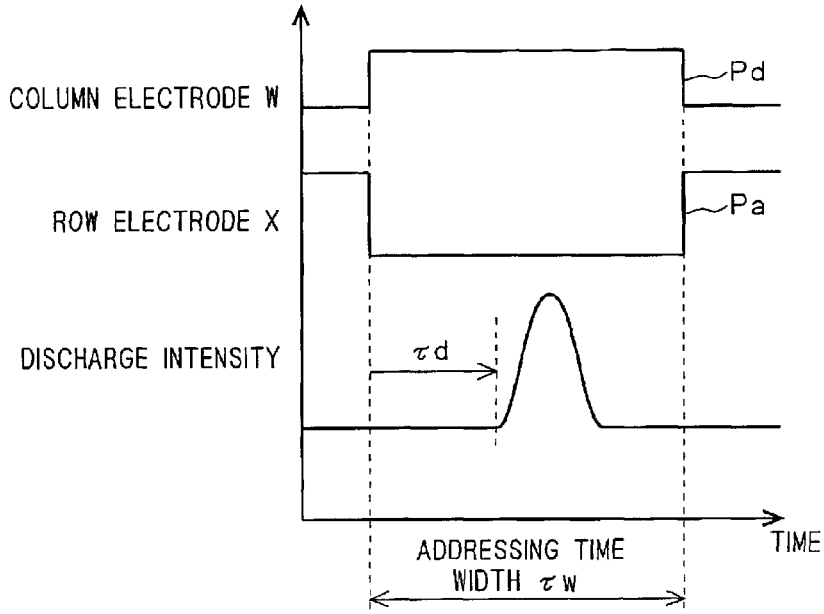
FIG. 32 is a timing chart used for explaining a discharge delay time.
Figure 33:
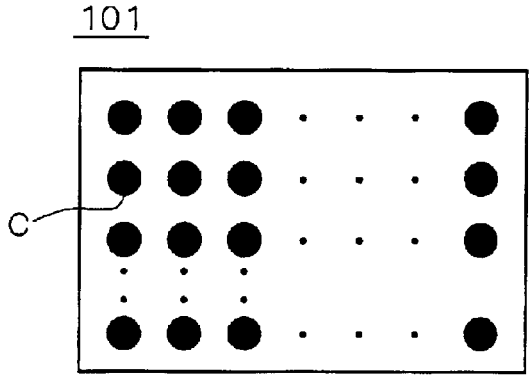
FIG. 33 is a schematic view of a plasma display panel, used for explaining a full lighting display.

The present driving method and the second background-art driving method are different from each other in that three round pulses Pxa, Pxb and Pxc are applied in the reset period of the present driving method while one trapezoidal pulse 610 is applied to the electrodes X in the reset period of the second background-art driving method (see FIG. 30).

Further, from the comparison of the discharges generated in the reset periods of the above two driving methods, it can be seen that the present driving method can produce the following effect. Specifically, it is possible to suppress an abnormal discharge between adjacent electrodes X and Y or adjacent discharge cells, which is caused by that the full lighting pulse is a higher voltage in one subfield. This effect can be obtained because the absolute values of the respective voltages v(t) of the potential control pulse Pxc and the pulse Pxa (strictly, the full lighting pulse in which the pulse Pxa superimposed on the pulse Pya to be applied between the electrodes X and Y) have the same tendency (increase or decrease tendency) in the present driving method, unlike in the second background-art driving method (see FIG. 30). In the present driving method, both the absolute values of the respective voltages v(t) of the potential control pulse Pxc and the pulse Pxa have an increase tendency. The above-discussed effect of suppressing the abnormal discharge will be discussed in detail, referring to FIGS. 8 to 19.

Figure 8:
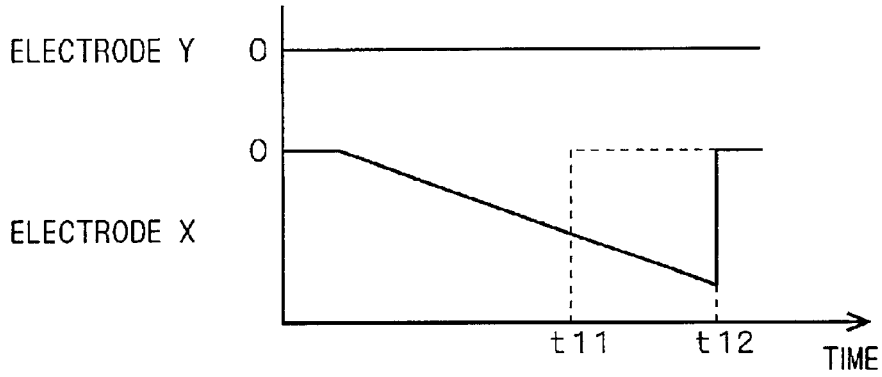
FIG. 8 is a timing chart used for explaining a round pulse.
Figure 9:
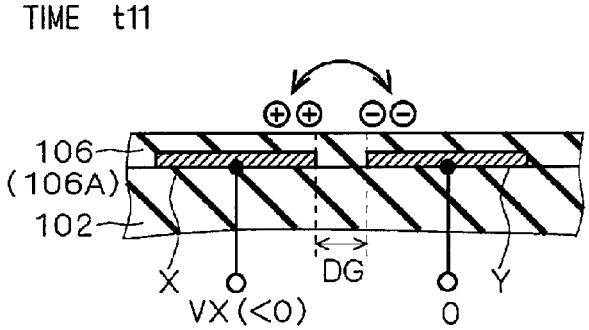
FIGS. 9 and 10 are schematic views showing states of wall charges in applying the round pulse.
Figure 10:
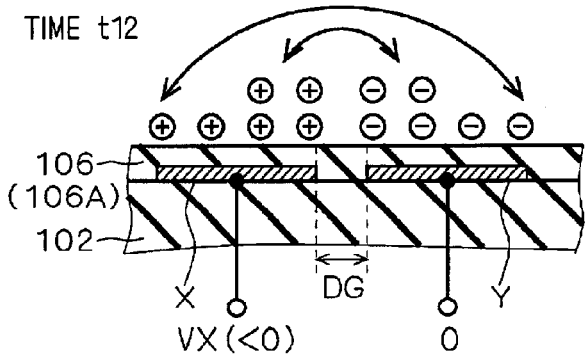

First, referring FIGS. 8 to 10, a basic characteristic feature of the round pulse will be discussed. FIG. 8 is an exemplary timing chart showing a round pulse. Herein, discussion will be made, taking a ramp pulse as an example of the round pulse. FIG. 8 shows a case where a ramp pulse of negative polarity is applied to the electrode X and the ground potential (GND) is applied to the electrode Y FIGS. 9 and 10 are schematic views showing states of the wall charges in applying the round pulse. In FIG. 9 and the like, the circled + represents a positive electric charge and the circled − represents a negative electric charge (electron). Further, the embowed arrow schematically represents (the range or size of) a discharge.

The round pulse has a characteristic feature that a discharge is started near the discharge gap DG and gradually extends away from the discharge gap DG as the applied voltage rises. In this case, when the potential of the electrode X is changed into the ground potential at time t11, in other words, when the voltage of the round pulse is relatively low, the discharge does not significantly extend from near the discharge gap DG and the wall charges are accumulated locally near the discharge gap DG as shown in FIG. 9. The above-discussed case of applying the potential control pulse Pxc and the like correspond to this state.

On the other hand, when the potential of the electrode X is changed into the ground potential at time t12 after the time t11, in other words, when the voltage of the round pulse is relatively high, the discharge extends away from the discharge gap DG and the wall charges are extended and accumulated away from the discharge gap DG, as shown in FIG. 10. The case of applying the full lighting pulse and the like correspond to this state.

Figure 11:
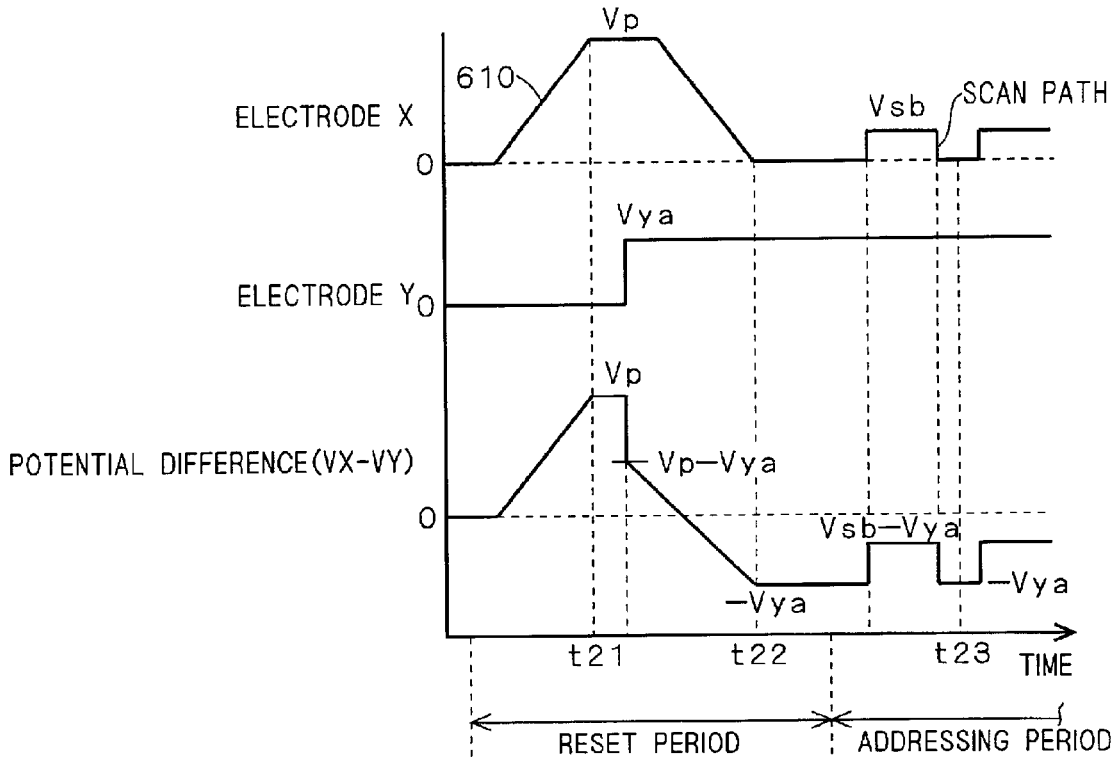
FIG. 11 is part of a timing chart of FIG. 30.
Figure 12:
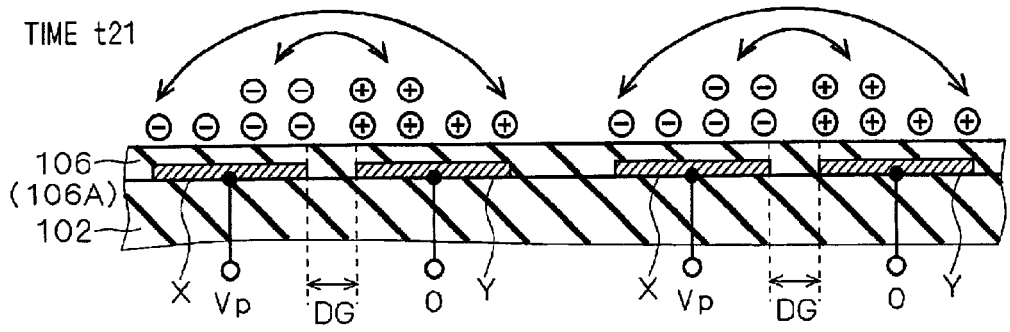
FIGS. 12 to 14 are schematic views showing states of wall charges in a driving operation according to the timing chart of FIG. 11.
Figure 13:
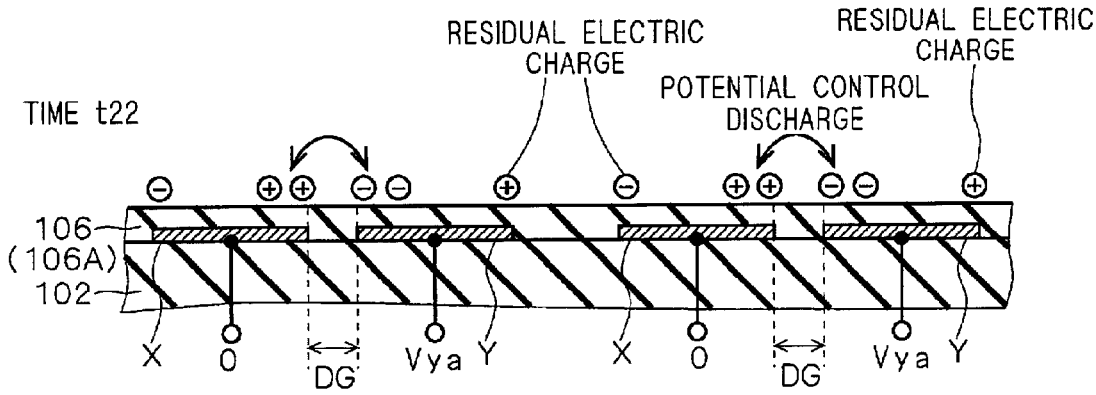
Figure 14:
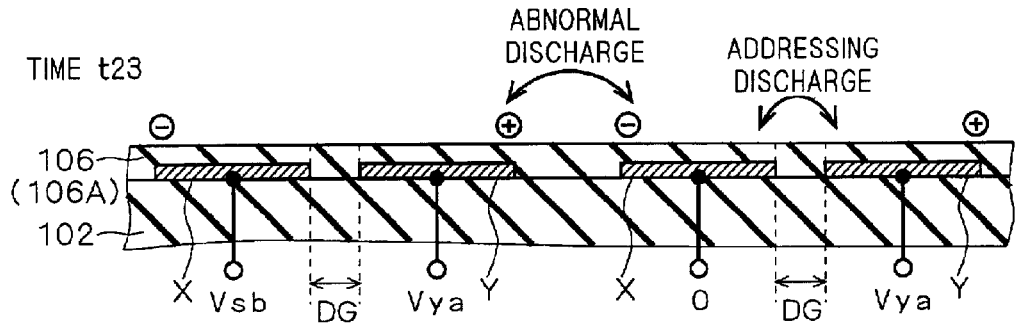
Figure 15:
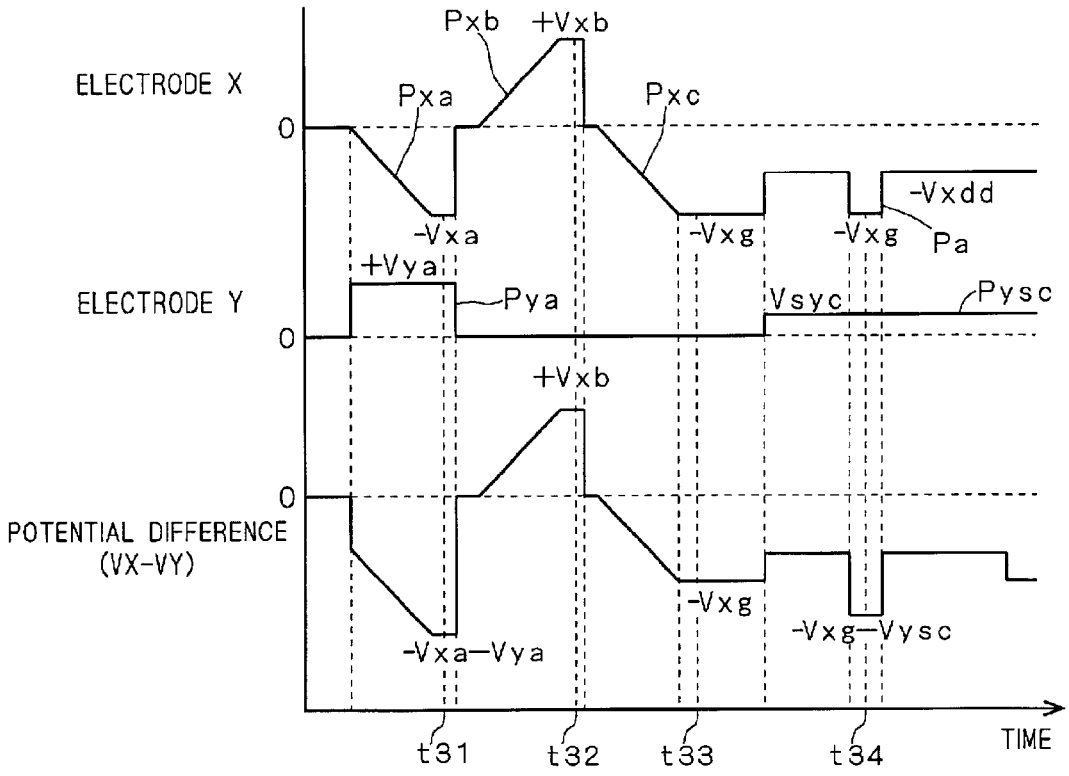
FIG. 15 is a timing chart used for explaining another method of driving a plasma display panel in accordance with the first preferred embodiment of the present invention.
Figure 16:
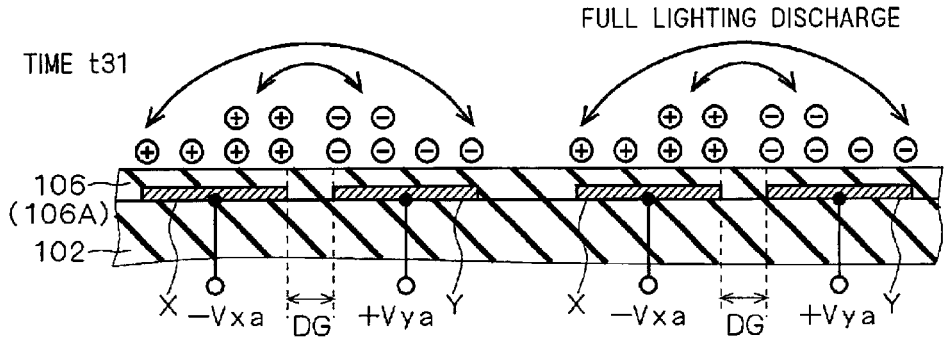
FIGS. 16 to 19 are schematic views showing states of wall charges in a driving operation according to the timing chart of FIG. 15.
Figure 17:
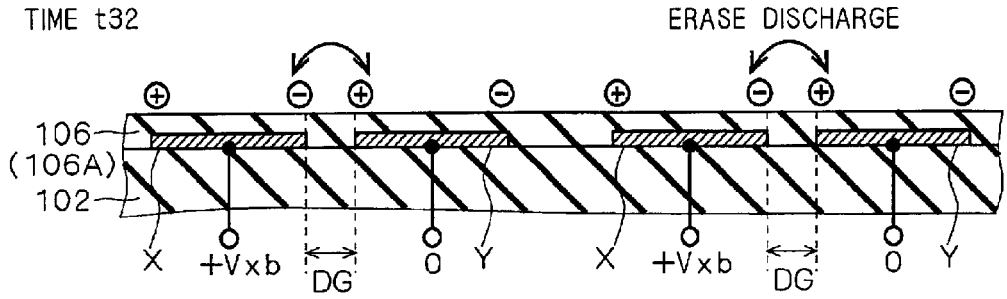

Next, referring to FIGS. 11 to 14, discussion will be made on the state of the wall charges in a case where the absolute values of the respective voltages of the full lighting pulse and the potential control pulse Pxc have opposite tendencies. FIG. 11 shows the reset period and part of the addressing period of the timing chart of FIG. 30. FIG. 11 shows waveforms of a voltage VX applied to the electrode X, a voltage VY applied to the electrode Y and the potential difference (VX−VY). FIGS. 12 to 14 are schematic views like FIG. 9 and the like.

The ramp pulse 610 rises, and a voltage Vp is applied to the electrode X and a voltage of 0 V is applied to the electrode Y at time t21. At this time, in the rise of the ramp pulse 610, the absolute values of the voltage VX and the potential difference (VX VY) have an increase tendency.

The rise of the ramp pulse 610 corresponds to the full lighting pulse in the driving method of the first preferred embodiment and the voltage Vp is set to be relatively high in order to generate a discharge in all the discharge cells. For this reason, the wall charges are accumulated up to a portion away from the discharge gap DG as shown in FIG. 12.

After that, the ramp pulse falls, and the voltage of 0 V is applied to the electrode X and the voltage Vya is applied to the electrode Y at time t22. At this time, in the fall of the ramp pulse 610, the absolute values of the voltage VX and the potential difference (VX−VY) have a decrease tendency.

The fall of the ramp pulse 610 corresponds to the potential control pulse Pxc in the driving method of the first preferred embodiment and the potential difference (VX−VY) is almost equal to the voltage in the addressing period, being a relatively low voltage. For this reason, a discharge (potential control discharge) is generated only near the discharge gap DG and only the wall charges near the discharge gap DG are reversed as shown in FIG. 13. With this operation, the sum of the wall charges and the externally-applied voltage is controlled to be an appropriate value for an addressing operation near the discharge gap DG while this control function does not work at the portion away from the discharge gap DG and the residual electric charges at the portion away from the discharge gap DG work to unnecessarily increase the potential difference (VX−VY).

As a result, at time t23 in the subsequent addressing period, an abnormal discharge is liable to be generated between adjacent discharge cells. This abnormal discharge causes problems in display such as not-lighting of a discharge cell which should be lighted or conversely, wrong lighting of a discharge cell which should not be lighted.

In contrast to this, in the case where the absolute values of the respective voltages of the full lighting pulse and the potential control pulse Pxc have the same tendency, like in the driving method of the first preferred embodiment, it is thought that the state of the wall changes as follows. Herein, discussion will be made on a case where the pulses Pxa, Pxb and Pxc are ramp pulses as shown in the timing chart of FIG. 15. FIGS. 16 to 19 are schematic views like FIG. 9 and the like.

First, the full lighting pulse consisting of the pulses Pxa and Pya (see the potential difference (VX−VY)) rises, and the voltage (−Vxa) is applied to the electrode X and the voltage Vya is applied to the electrode Y at time t3. At this time, in the rises of the pulses Pxa and Pya, the absolute values of the voltage VX and the potential difference (VX−VY) have an increase tendency. As discussed above, since the full lighting pulse has a relatively high voltage, the discharge (full lighting discharge) extends up to a portion away from the discharge gap DG and the wall charges are accumulated up to the portion away from the discharge gap DG.

Next, the full erase pulse Pxb rises, and the voltage. Vxb is applied to the electrode X and the voltage of 0 V is applied to the electrode Y at time t32. With this erase operation or erase discharge, the polarity of the wall charges near the discharge gap DG is reversed (see FIG. 17). Further, it is not necessary to make the amount of wall charges zero by this erase operation as discussed earlier.

Figure 18:
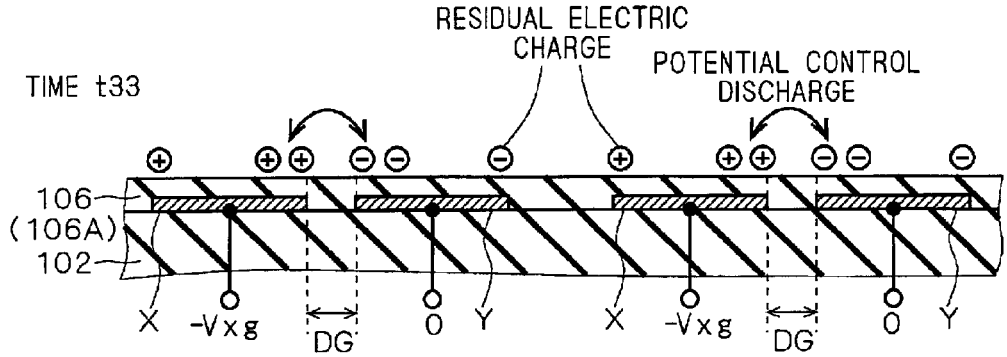
Figure 19:
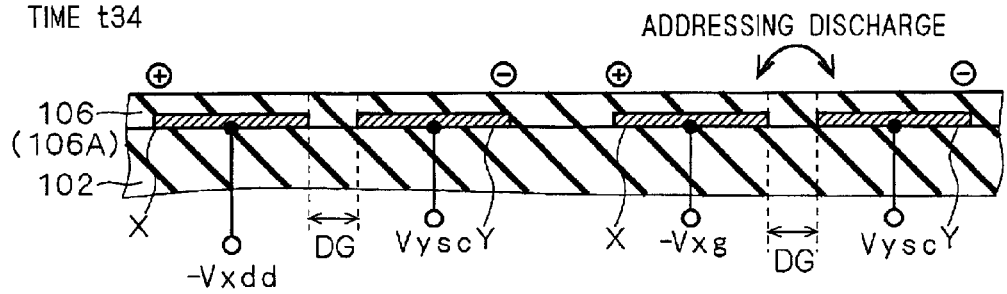

Then, the potential control pulse Pxc rises, and the voltage (−Vxg) is applied to the electrode X and the voltage of 0 V is applied to the electrode Y at time t33. At this time, in the rise of the pulse Pxc, the absolute values of the voltage VX and the potential difference (VX−VY) have an increase tendency, like in the case of the full lighting pulse. Since the potential control pulse Pxc has a relatively low voltage, the potential control discharge is generated only near the discharge gap DO and the polarity of the wall charges is reversed again as shown in FIG. 18. At this time, the above potential control function works near the discharge gap DG.

On the other hand, at the portion away from the discharge gap DG, the potential control function does not work and the wall charges accumulated at the application of the full lighting pulse are left. Since both the absolute values of the respective voltages of the pulse Pxa or full lighting pulse and the pulse Pxc have the same tendency, however, the residual electric charges work to suppress the potential difference (VX−VY) between the electrodes X and Y in the addressing period. As a result, in the driving method of the first preferred embodiment, since the abnormal discharge between adjacent discharge cells is hard to generate as compared with the second background-art driving method (see FIG. 30), a high-quality display can be achieved.

Further, the driving method of the first preferred embodiment can produce the following effect. Specifically, the final voltage of the potential control pulse Pxc is set to a negative potential (−Vxg) relative to the reference potential (0 V) of the electrode W in the present driving method as discussed above. With this setting of the voltage, since the potential difference is also given between the electrodes W and X when the potential control pulse Pxc is applied, it is possible to automatically control the voltage not only across the electrodes X and Y but also across the electrodes W and X during the addressing operation to a constant value. Therefore, both two kinds of discharges during the addressing operation, i.e., the discharge between the electrodes X and Y and the discharge between the electrodes W and X can be stabilized. With this stabilization, the driving margin is enlarged and therefore the operation can be stabilized.

Furthermore, since it can respond to a change with time, the lifetime of the PDP 51 becomes longer.

Further, since the positive and negative pulses are applied to the electrode X in the reset period of the present driving method, the voltage of each of the positive and negative pulses is lower than that in a case, e.g., where only the positive pulse is applied. Therefore, since the voltage across the electrodes X and W becomes relatively low, it is possible to suppress the discharge with the electrode W as a cathode and further suppress the deterioration of the phosphor layer caused by this discharge.

Furthermore, though the above discussion is made on the case where the CR pulse is used as the pulses Pxa, Pxb, Pxc and Pxd, the ramp pulse can be used, and the LC resonant pulse which can be generated by combining a reactor and a capacitor can be used. Further, a waveform in a rise region or fall region in the switching characteristics of a field effect transistor may be used. Furthermore, there may be a case where various types of round pulses are combined, e.g., the ramp pulses are used as the pulses Pxa and Pxc and the CR pulses are used as the pulses Pxa and Pxd.

<The Second Preferred Embodiment>

Figure 20:
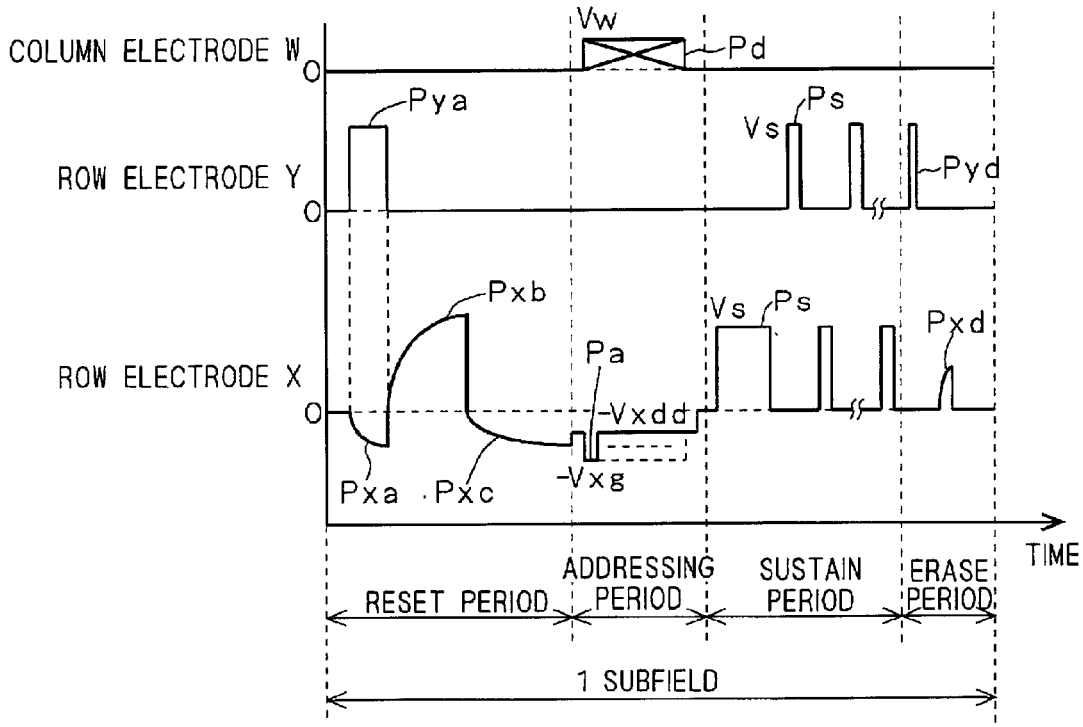
FIG. 20 is a timing chart used for explaining a method of driving a plasma display panel in accordance with a second preferred embodiment of the present invention.

FIG. 20 is a timing chart used for explaining a method of driving a PDP in accordance with the second preferred embodiment. Further, in the following discussion, constituent elements identical to already-discussed ones are given the same reference signs, and the description thereof is omitted herein. From the comparison between FIG. 20 and FIG. 5 discussed earlier, it can be seen that the driving method of the second preferred embodiment is different from that of the first preferred embodiment in the final voltages of the pulses Pxc and Pxa. Further, no secondary scanning pulse Pysc is applied during the addressing period in the present driving method. Other features of the present driving method are the same as those of the driving method of the first preferred embodiment.

As discussed earlier, the voltage of the pulse Pxc is set to the voltage Vxg in the driving method of the first preferred embodiment. This makes the amount of wall charges generated with the potential control pulse Pxc corresponding to the voltage Vxg even if the voltage Vxg changes. After that, in the addressing operation, a potential difference in which the voltage Vysc of the secondary scanning pulse Pysc is superimposed on the potential difference after the application of the pulse Pxc is applied between the electrodes X and Y.

In contrast to this, in the present driving method, the final voltage of the pulse Pxc is set to a voltage which is lower than the voltage Vxg by the voltage Vysc of the secondary scanning pulse Pysc with respect to the absolute value. Specifically, the final voltage of the pulse Pxc is set to −(Vxg−Vysc), and the potential of the electrode X at the end of application of the pulse Pxc is set to a value between the potential. −Vxg of the electrode X during the addressing period and the ground potential (GND). Therefore, positive wall charges are accumulated on the electrode Y as compared with the case where the final voltage of the pulse Pxc is set to Vxg, and similarly negative wall charges are accumulated on the electrode X as compared with the case where the final voltage of the pulse Pxc is set to Vxg. At this time, the difference in wall charges at the end of the reset period between the first and second preferred embodiments corresponds to the voltage Vysc in terms of wall voltage. Accordingly, even when the final voltage of the pulse Pxc is set to −(Vxg−Vysc), by reducing the potential difference between the electrodes X and Y in the addressing period by the voltage Vysc as compared with the driving method of the first preferred embodiment, the operation in the addressing period can be made equivalent. Specifically, since no secondary scanning pulse Pysc is applied in the driving method of the second preferred embodiment, the potential difference between the electrodes X and Y during the addressing operation can be made equal to that in the driving method of the first preferred embodiment.

Therefore, in the present driving method, since no pulse generation circuit for the secondary scanning pulse Pysc is needed, it is possible to simplify the constitution of the driving device of the plasma display device 50 and reduce the cost thereof. Moreover, in the present driving method, an effect that the secondary scanning pulse Pysc produces, i.e., an effect of enlarging the operating margin can be achieved without the pulse generation circuit for the secondary scanning pulse Pysc.

Further, the pulse Pxc can be generated by stopping the application of the pulse before reaching the final attainment voltage in the case of continuing the application of the pulse, like the pulse Pxa discussed in the first preferred embodiment. For example, by using a power supply (voltage Vxg) of a circuit for generating the address pulse Pa and stopping the application of the pulse before the voltage reaches the voltage Vxg, it becomes possible for the address pulse Pa and the pulse Pxc to share the power supply. Therefore, the driving device can be simplified and the manufacturing cost can be reduced.

<The Third Preferred Embodiment>

Figure 21:
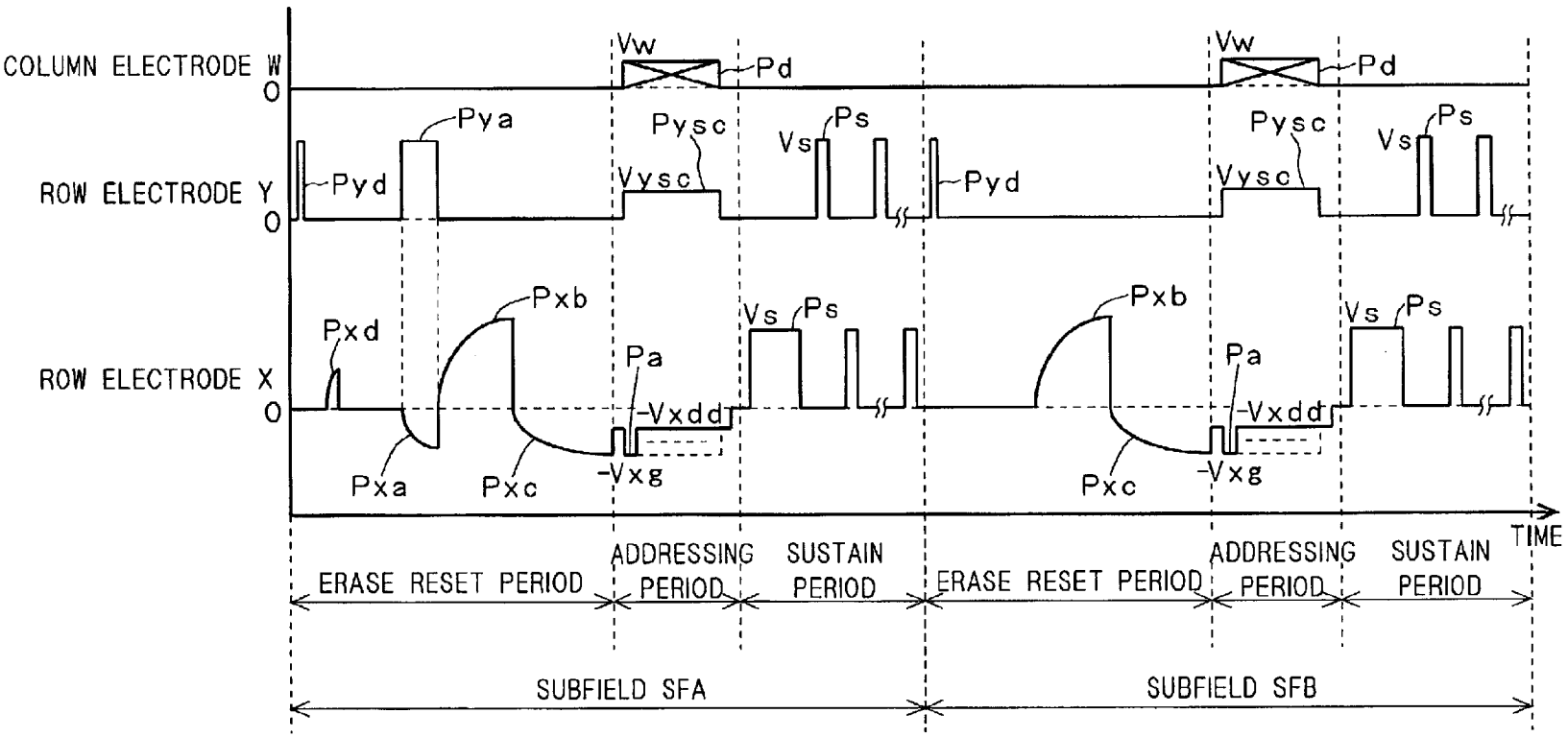
FIG. 21 is a timing chart used for explaining a method of driving a plasma display panel in accordance with a third preferred embodiment of the present invention.

Next, a driving method in the plasma display device 50 in accordance with the third preferred embodiment will be discussed. FIG. 21 is a timing chart used for explaining the present driving method. As shown in FIG. 21, the driving method includes two kinds of subfields SFA and SFB. Since the characteristic feature of this preferred embodiment lies in the respective erase/reset periods of the subfields SFA and SFB, discussion will be centered on the erase/reset periods of the subfields SFA and SFB. Further, since the addressing periods and the sustain periods of the subfields SFA and SFB are the same as those of the driving method shown in FIG. 5, the discussion thereof is omitted herein.

The erase/reset period of the subfield SFA corresponds to a period in which the erase period of the first preferred embodiment is set before the reset period and the erase period and the reset period are combined. In this erase/reset period of the subfield SFA, a full lighting and a full erase are performed.

On the other hand, the erase/reset period of the subsequent subfield SFB corresponds to a case where neither the pulse Pxd nor the pulses Pya and Pxa (constituting the full lighting pulse) are applied in the subfield SFA. In the erase/reset period of the subfield SFB, subsequent to the pulse Pyd, the pulse Pxb is applied. Specifically, neither the full lighting nor any operation of reducing the wall charges for the full lighting is performed.

Thus, in the subfield SFA, the full lighting is once performed and then the full erase is performed while in the subfield SFB the erase operation is performed in the discharge cell(s) lighted in (the sustain period of) the immediately preceding subfield.

At this time, the erase operation (in the subfield SFB) in which only the discharge cells lighted in the immediately preceding subfield are lighted again sometimes needs changes of parameters such as the set voltage and the application time of the pulse as compared with the erase (in the subfield SFA) in which all discharge cells are lighted regardless of the display history.

Figure 22:
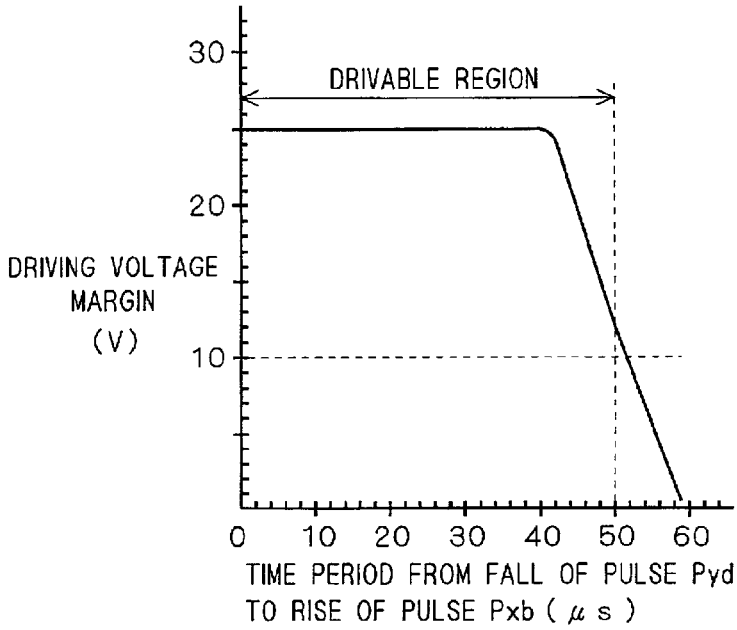
FIG. 22 is a graph used for explaining a condition for driving the plasma display panel in accordance with the third preferred embodiment of the present invention.

FIG. 22 is a graph used for explaining the relation between the time period from the fall of the pulse Pyd to the rise of the pulse Pxb (or the length of a break period or interval between the applications of the pulses Pyd and Pxb) and the driving voltage margin.

As shown in FIG. 22, when the break period between the applications of the pulses Pyd and Pxb is not longer than 40 μs, the driving voltage margin is constant, substantially 25 V. Further, when the break period exceeds 40 μs, the driving voltage margin starts decreasing and when the break period is about 60 μs, the driving voltage margin becomes substantially 0 V. At this time, it can be seen that by setting the break period to substantially 50 μs, the driving voltage margin of about 10 V or higher can be obtained. Then, in the present driving method, the break period between the applications of the pulses Pyd and Pxb is set to not higher than 50 μs. The reason for a wide driving voltage margin in the case where the break period between the former voltage pulse Pyd and the latter voltage pulse Pxb is short in the subfield SFB is considered as follows. As discussed above, as the pulse Pyd used is a voltage pulse (herein, rectangular wave) which changed more sharply than the pulse Pxb and is capable of generating the discharge at the rise and fall. Therefore, by applying the round pulse Pxb in a period while the priming particles generated in the strong discharge (by applying the voltage pulse which sharply changes) by the pulse Pyd still remain, a weak discharge by the round pulse Pxb smoothly starts.

As discussed earlier, when the rise time of the round pulse is longer than the discharge delay time and the round pulse rises sufficiently slow, a very weak discharge starts at the minimum voltage value and continues. At this time, though with the round pulse, an effect that a predetermined amount of wall charges which depend on the final potential of the round pulse are stably generated can be produced, if the round pulse rises too fast, the discharge becomes too strong and the above effect can not be produced.

Since the discharge delay time becomes shorter in the application of the round pulse by applying the round pulse Pxb in a period while the priming particles sufficiently remain, however, even if the round pulse rises fast in a relatively short rise time, a weak discharge can smoothly start. In other words, the designing flexibility of the round pulse for generating the weak discharge can be enhanced.

Further, as shown in FIG. 21, by subsequently applying the round pulses Pxa, Pxb and Pxc (before the priming particles generated by the preceding round pulse are completely extinguished), also with the following round pulses Pxa, Pxb and Pxc, weak discharges can smoothly start.

Further, the states of the wall charges after the application of the pulse Pxb in the subfields SFA and SFB are equivalent to each other from the characteristic feature of the round pulse that the state of the wall charges depends on the final voltage of the round pulse. Therefore, the same operation is performed after the application of the pulse Pxb both in the subfields SFA and SFB. Furthermore, the pulse Pxa having the final voltage Vxc={−(Vxg−Vysc)} in the driving method of the second preferred embodiment may be used.

In the present driving method, since neither the pulse Pxd nor the pulses Pya and Pxa (constituting the full lighting pulse) are applied in the subfield SFB, it is possible to reduce the luminescence irrelevant to the display emission. This allows an improvement in contrast as compared with the driving methods of the first and second preferred embodiments.

Further, in the present driving method, there arises a time margin in one field, as compared with the driving methods of the first and second preferred embodiments, by not application of the full lighting pulse and the like in the subfield SFA. Therefore, by utilizing the time margin for an increase in the number of sustain pulses or subfields and the like, the luminance of light emission and the number of tones can be increased to improve the display quality.

Furthermore, though the above discussion is made on the case where the subfield SFA and the subfield SFB are sequentially executed, the order of the subfields SFA and SFB and the number of executions are optional. For example, there may be a case where the subfield SFA is continuously executed more than one time and then the subfield SFB is executed one time or continuously executed more than one time. Further, there may another case where the subfield SFA is executed one or two times and all the remaining subfields in the field are executed as the subfield SFB. Specifically, by performing the full lighting only in a specific subfield, the above effect can be produced.

<Variation>

In the above first to third preferred embodiments, discussion has been made on the case where the CR pulse is applied to the electrode X, there may be a case where the round pulse generation circuit 14*a*6 or the like is provided in the driving device(s) 15 and/or 18 to apply the CR pulse or the like to the electrode(s) Y and/or W, respectively. Specifically, any one of the electrodes X, Y and W can correspond to the first electrode or the second electrode. For example, the CR pulse or the like can be thereby applied between the row electrodes X and Y or between the row electrode X or Y and the column electrode W in order to erase the wall charges. In this case, the electrode to which the CR pulse or the like is applied corresponds to the first electrode and the driver 14*a*, 15*a* or 18*a* thereof corresponds to the driving unit. Further, the CR pulse or the like may be applied to a plurality of electrodes.

Further, in the driving method of FIG. 21, by the driving unit including X driver 14*a* for the electrode X and the Y driver 15 for the electrode Y, the former pulse Pyd and the latter pulse Pxb are applied in the subfield SFB to the electrodes Y and X, respectively.

<The Fourth Preferred Embodiment>

In the second preferred embodiment, the operation in the case where the final voltage of the pulse Pxc is set to −(Vxg−Vysc) is discussed, paying attention to the potential difference between the electrodes X and Y. In the fourth preferred embodiment, discussion will be made on a case where the final voltage of the pulse Pxc is different from the voltage of the address pulse Pa, like in the second preferred embodiment, paying attention to the potential difference between the electrodes X and W.

Further, though the row electrode X corresponds to the first electrode and the row electrode Y corresponds to the second electrode in the first to third preferred embodiments, the row electrode X corresponds to the first electrode and the column electrode W corresponds to the second electrode in the fourth and fifth preferred embodiments. In this case, a constitution including the driving device 14 for the electrode X and the driving device 18 for the electrode W corresponds to the driving unit.

Figure 23:
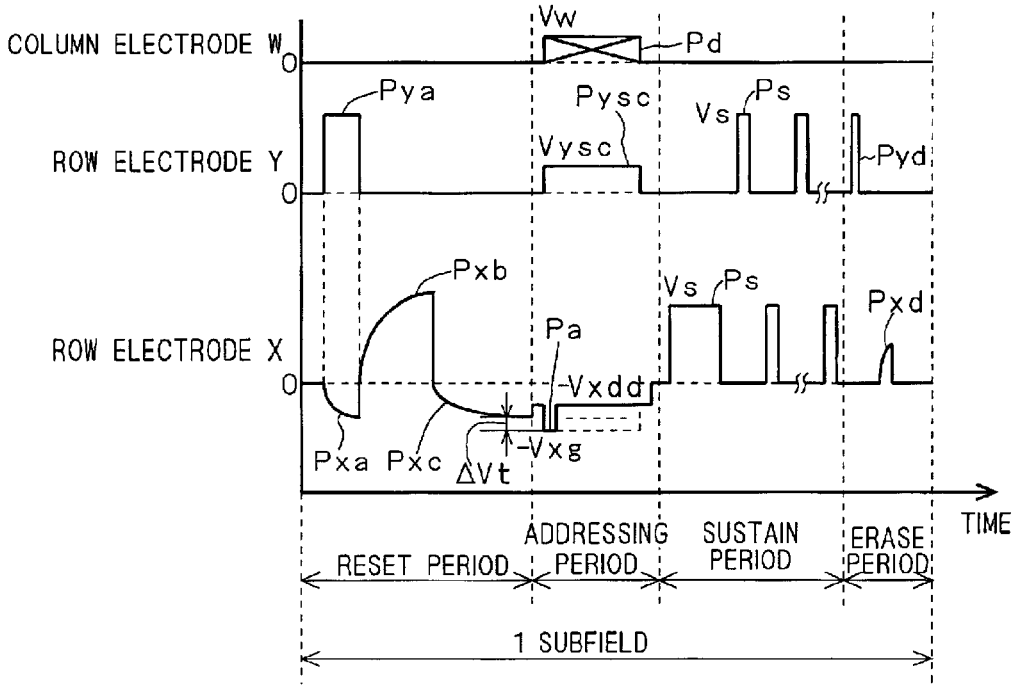
FIGS. 23 and 24 are timing charts used for explaining a method of driving a plasma display panel in accordance with a fourth preferred embodiment of the present invention.

FIG. 23 is a timing chart used for explaining a method of driving a PDP in accordance with the fourth preferred embodiment of the present invention. In FIG. 23, the waveforms of voltages applied to the column electrode W and the row electrode Y are the same as those of FIG. 5 and the waveform of a voltage applied to the row electrode X is the same as that of FIG. 5 except for the final voltage of the potential control pulse Pxc.

As discussed earlier, in the driving method of the first preferred embodiment (see FIG. 5), the final voltage of the potential control pulse Pxc is set to the voltage (−Vxg) of the address pulse Pa. With this voltage setting, the amount of wall charges generated by the potential control pulse Pxc can respond to the voltage Vxg even when the voltage Vxg varies. Paying attention to the discharge cell to which no data pulse Pd is applied, particularly, the potential difference between the electrodes X and W at the point of time when the potential control pulse Pxc reaches the final voltage is equal to that at the point of time when the address pulse Pa is applied. Therefore, no wrong discharge is generated when the address pulse Pa is applied.

In contrast to this, in the driving method of the fourth preferred embodiment, the magnitude (or absolute value) of the final voltage of the pulse Pxc is set to a voltage which is lower than the magnitude (or absolute value) of the voltage Vxg by the voltage ΔVt (>0). In other words, the final voltage of the pulse Pxc is set to −(|Vxg|−ΔVt).

Specifically, in the driving method of FIG. 5, when the application of the pulse Pxc starts, the potential difference between the electrodes X and W in each discharge cell gently becomes closer to that in the discharge cell to which no data pulse Pd is applied in the addressing period, i.e., the potential (−Vxg). In contrast to this, in the driving method of FIG. 23, the change of the pulse Pxc is stopped before it reaches the potential difference between the electrodes X and W in the discharge cell to which no data pulse Pd is applied (i.e., the potential (−Vxg)).

Further, in both the second and fourth preferred embodiments, the pulse Pxc and the address pulse Pa are pulses which changes in the direction of decreasing the voltage (of increasing the absolute value of the negative voltage), whose voltages change in the same direction.

Figure 24:
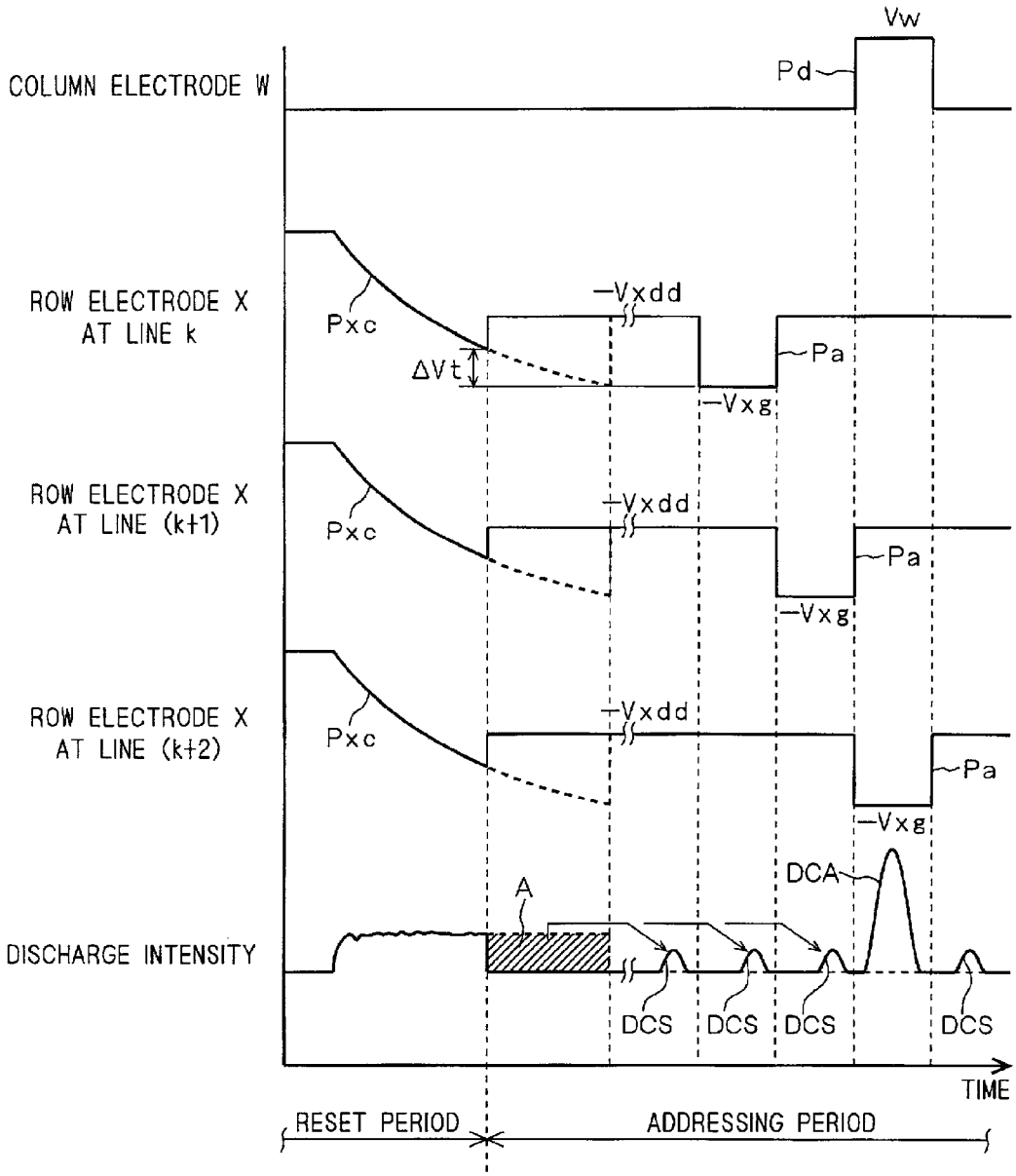

With this setting in the driving method of FIG. 23, an operation which is utterly different from that in the background-art driving method is performed in the following addressing period. This operation will be discussed, referring to the timing chart of FIG. 24. FIG. 24 is a timing chart, extracting the period from the start of application of the pulse Pxc to the addressing period from FIG. 23. FIG. 24 shows waveforms of voltages applied to the column electrode W, the row electrode X at line k, the row electrode X at line (k+1) and the row electrode X at line (k+2), and the waveform of discharge intensity. Further, for comparison, the waveforms of the pulse Pxc and its discharge intensity in the driving method of FIG. 5 are represented by broken lines.

In the driving method shown in FIGS. 23 and 24, when the address pulse Pa is applied, a discharge (the second discharge) DCS which is weaker than an addressing discharge (or writing discharge or the first discharge) DCA is generated between the column electrode W and the row electrode X in a discharge cell to which no data pulse Pd is applied, i.e., a discharge cell in which no addressing discharge DCA is generated. In the following discussion, this weak discharge is referred to as "secondary discharge". On the other hand, the addressing discharge DCA (which is stronger than the secondary discharge DCS) in the discharge cell to which the data pulse Pd is applied.

It is considered that the secondary discharge DCS in the driving method of FIGS. 23 and 24 is caused by that the potential difference between the electrodes X and W in the application of the address pulse Pa is higher than the final voltage of the potential control pulse Pxc by the voltage ΔVt. This is a variation of the discharge generated during a period while the pulse Pxc changes from the voltage (−Vxg+ΔVt) to the voltage (−Vxg) in the driving method of FIG. 5 (see the hatched portion A in the waveform of discharge intensity in FIG. 24), as the secondary discharge DCS. Specifically, the discharge represented by the hatched portion A of FIG. 24 is dispersed at each application of the address pulse Pa, shifting the timing.

The intensity of the secondary discharge DCS can be controlled by the value of the voltage ΔVt, and the secondary discharge DCS becomes stronger (larger) as the voltage ΔVt is larger. Herein, the voltage ΔVt is controlled and set so that the secondary discharge DCS may become weak enough not to act as the addressing discharge DCA.

Further, as discussed above, since the addressing discharge DCA which is sufficiently stronger (than the secondary discharge DCS) is generated in the discharge cell to which the data pulse Pd is applied, like in the driving method of the first preferred embodiment, it is possible to control lighting/not-lighting in the sustain period by application/not-application of the data pulse Pd.

Figure 25:
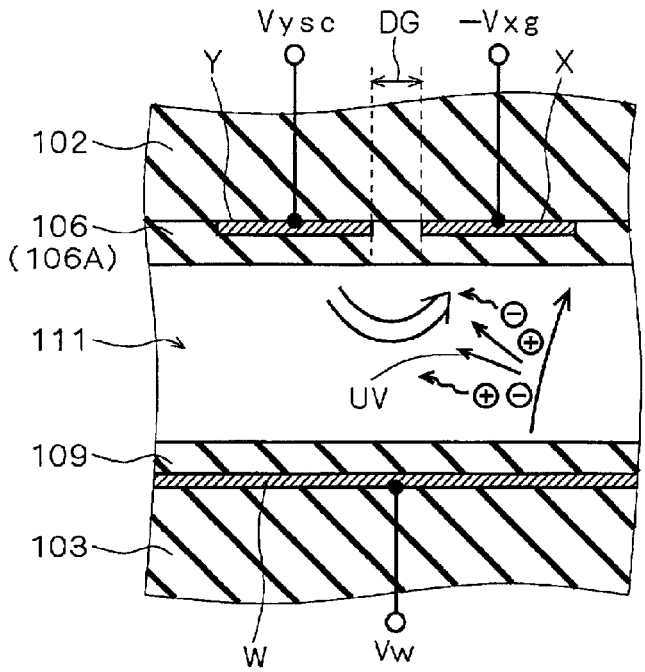
FIG. 25 is a schematic view used for explaining discharge generation in a case of applying a data pulse in the method of driving a plasma display panel in accordance with the fourth preferred embodiment of the present invention.

The operation will be discussed, taking the write addressing method as example. First, a schematic view used for explaining generation of a discharge in the case of applying the data pulse Pd in the driving method in accordance with the fourth preferred embodiment, i.e., generation of the addressing discharge is shown in FIG. 25. When the data pulse Pd is applied, a strong discharge is generated by the voltage (ΔVt+Vw) between the electrodes X and W. This discharge is sufficiently strong and generates a large amount of charged particles (see the mark in which + or − surrounded by ○) and ultraviolet rays UV. With these charged particles and ultraviolet rays, the firing voltage in the discharge cell is lowered and subsequently the discharge is generated between the electrodes X and Y. At this time, since there is a potential difference (|Vxg|+Vysc) between the electrodes X and Y, a relatively large amount of wall charges corresponding to the potential difference are accumulated. With this effect of the wall charges, the sustain discharge is generated in the subsequent sustain period. Further, the addressing discharge refers to a general term of the discharges between the electrodes X and W and between the electrodes X and Y.

Figure 26:
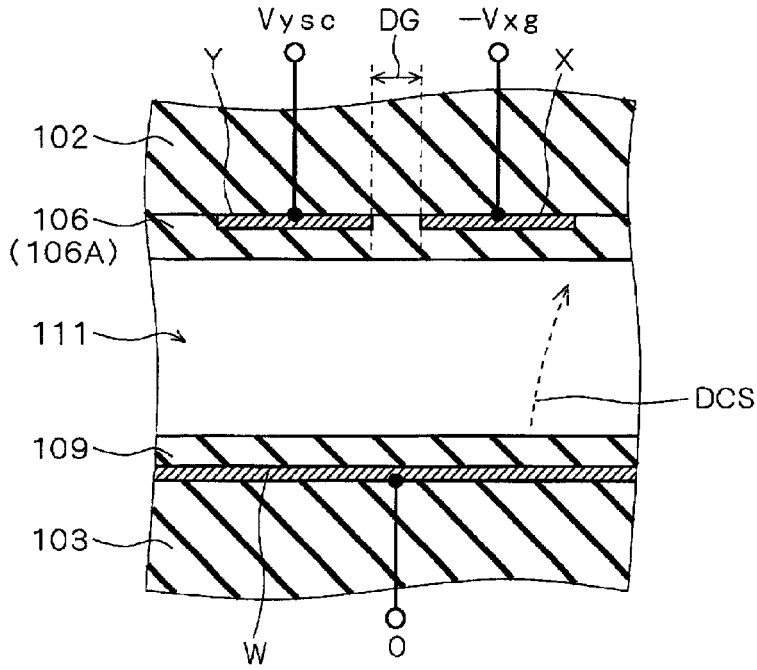
FIG. 26 is a schematic view used for explaining discharge generation in a case of not applying a data pulse in the method of driving a plasma display panel in accordance with the fourth preferred embodiment of the present invention.

Next, a schematic view used for explaining generation of a discharge in the case of not applying the data pulse Pd in the driving method in accordance with the fourth preferred embodiment, i.e., generation of the secondary discharge DCS is shown in FIG. 26. When the data pulse Pd is not applied, a weak discharge by the above voltage ΔVt, i.e., the secondary discharge DCS is generated between the electrodes X and W. Since the secondary discharge DCS is very weak, only a little amount of wall charges are accumulated by this generation of the discharge. Moreover, since the secondary discharge DCS is set so as not to induce the discharge between the electrodes X and Y, no discharge is generated between the electrodes X and Y and a sufficient amount of wall charges are not accumulated between the electrodes X and Y. Therefore, no sustain discharge is generated in the subsequent sustain period. At this time, the charged particles, quasi-stable particles and the like generated by the secondary discharge DCS are diffused in the discharge cells therearound, serving as priming particles.

The secondary discharge DCS and the addressing discharge DCA are generated in synchronization with the application of the address pulse Pa to each row, and either the secondary discharge DCS or the addressing discharge DCA is generated in each discharge cell. In other words, in the driving method of the fourth preferred embodiment, either the secondary discharge DCS or the addressing discharge DCA is generated during the operation for defining whether the discharge cell should be illuminated for display or not, regardless of whether the discharge cell is illuminated for display or not.

At this time, since part of charged particles and the like generated by the addressing discharge DCA work as the priming particles, like those by the secondary discharge DCS, both the addressing discharge DCA and the secondary discharge DCS can be generated very stably. Specifically, since the priming particles generated by the secondary discharge DCS and/or the addressing discharge DCA in the discharge cell belonging to the electrode X at line k are diffused to the discharge cell belonging to the electrode X at line (k+1), the secondary discharge DCS and/or the addressing discharge DCA can be generated stably in the discharge cell at line (k+1). Further, since the priming particles generated by the secondary discharge DCS and/or the addressing discharge DCA in the discharge cell belonging to the electrode X at line (k+1) are diffused to the discharge cell belonging to the electrode X at line (k+2), the secondary discharge DCS and/or the addressing discharge DCA can be generated stably in the discharge cell at line (k+2). Thus, in accordance with the scanning of the electrode X in the addressing period, the priming particles are transmitted to the adjacent discharge cell one after another, whereby the secondary discharge DCS and/or the addressing discharge DCA can be generated reliably with a constant discharge delay time $\tau d$ in all the discharge cells (therefore, in the whole PDP). In the case of the driving method in which the addressing period and the sustain period are separated, particularly, since the addressing operation is performed collectively in a period, the secondary discharge DCS is likely to be stabilized. Further, the same discussion applies to the erase addressing method.

Figure 34:
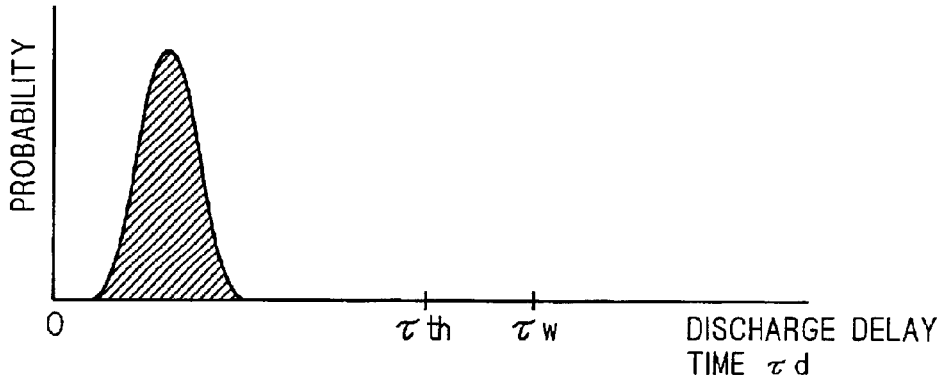
FIG. 34 is a schematic view used for explaining probability distribution of the discharge delay time in the full lighting display.
Figure 35:
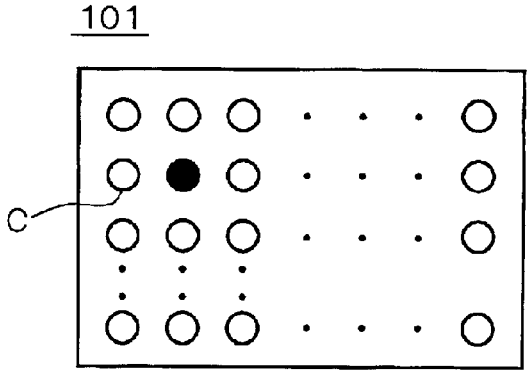
FIG. 35 is a schematic view of a plasma display panel, used for explaining a solitary lighting display.
Figure 36:
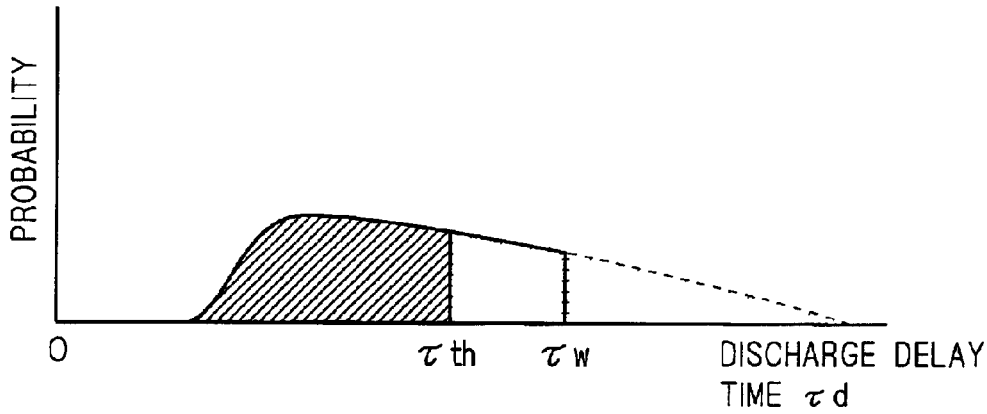
FIG. 36 is a schematic view used for explaining probability distribution of the discharge delay time in the solitary lighting display.

Thus, with the priming effect caused by the addressing discharge DCA and the secondary discharge DCS, the distribution of discharge delay time $\tau d$ of the addressing discharge DCA can be made closer to that of FIG. 34 in the adjacent discharge cell to be selected next. This allows reliable and stable generation of the addressing discharge DCA as compared with the case where no secondary discharge DCS is generated (in particular, the case of the solitary lighting display), thereby providing an image of high quality in which the flicker or the like is suppressed.

The operation system for stably generating the secondary discharge DCS can be understood as a phenomenon similar to a trigger discharge in a trigger system DC-type PDP (disclosed in e.g., Japanese Patent Application Laid Open Gazette No. 7-73811). The driving method of the fourth preferred embodiment, however, is different from the above background art in the following points. While the trigger discharge is generated in the trigger system DC-type PDP regardless of whether a DC discharge for display luminescence is generated or not, the secondary discharge DCS is generated in the discharge cell which is not illuminated for display in the driving method of the fourth preferred embodiment. Further, while the trigger discharge is generated when the display luminescence is caused in the trigger system DC-type PDP, the secondary discharge DCS is generated in the addressing period before the sustain period in which the display luminescence is caused in the fourth preferred embodiment. Furthermore, in the driving method of the fourth preferred embodiment, with the difference in intensity of the addressing discharge DCA and the secondary discharge DCS generated in the addressing period (or during the addressing operation), lighting/non-lighting in the sustain period after the addressing period is stably controlled, in other words, a memory function of the AC-type PDP is stabilized.

Figure 29:
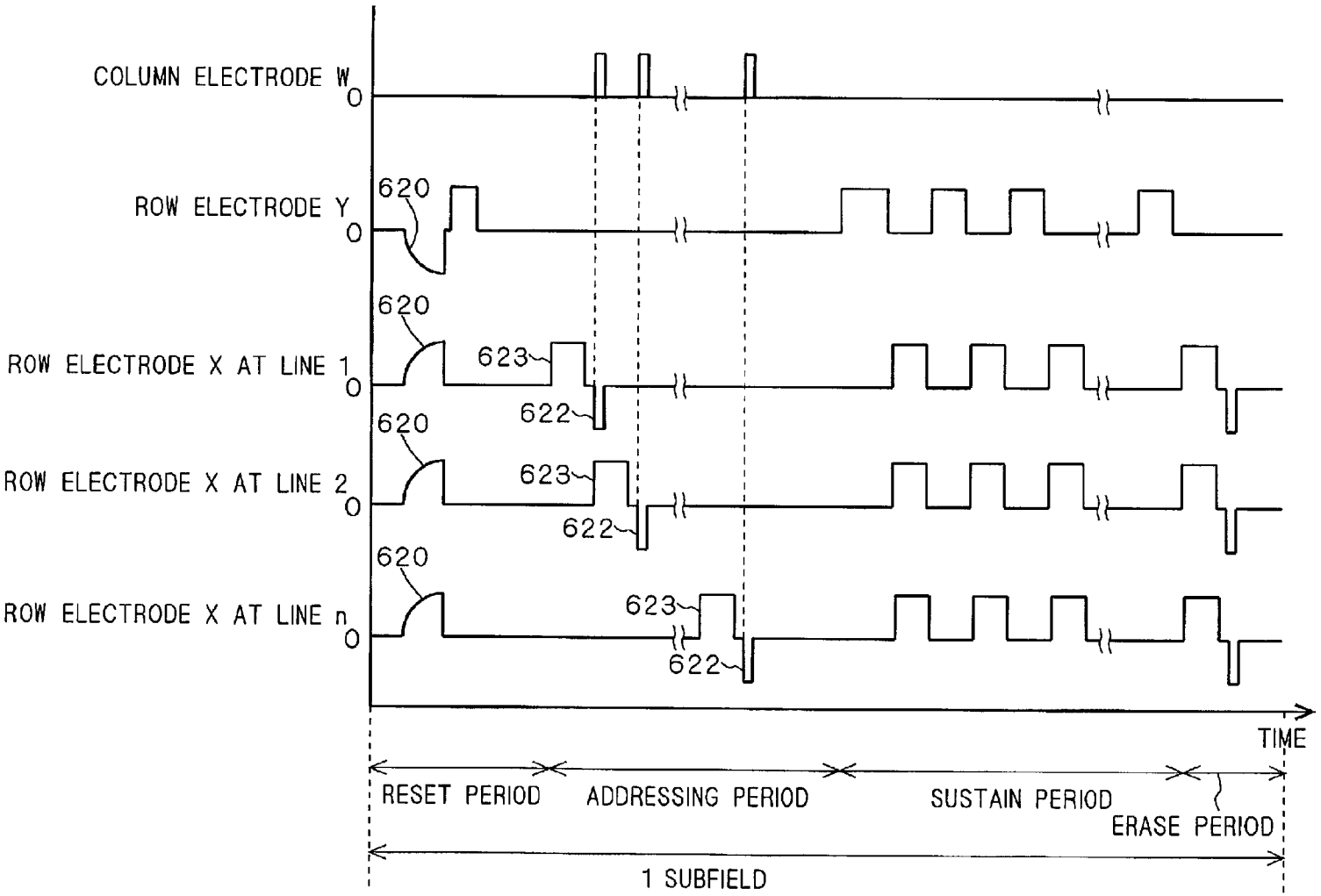
FIG. 29 is a timing chart used for explaining a first background-art method of driving a plasma display panel.

In the driving method of the fourth preferred embodiment, the address pulse Pa has both the functions of row selection for the addressing discharge DCA and generation of the secondary discharge DCS. In contrast to this, in the driving method of FIG. 29, the priming pulse 623 is applied apart from the address pulse 622 (therefore, apart from the operation for defining whether the discharge cell should be illuminated for display or not). The driving method of the fourth preferred embodiment is different from the above background art in this point. With this difference, the driving device in the driving method of the fourth preferred embodiment is simpler and the cost is lower than that in the driving method of FIG. 29.

Further, the driving method of the fourth preferred embodiment can be performed by using a general three-electrode surface discharge type PDP. Specifically, it is not necessary to separately provide another electrode for secondary discharge, for example, and the manufacturing process of the PDP is not complicated.

Furthermore, as discussed above, since the secondary discharge DCS can be regarded as a dispersed one of the discharge represented by the hatched portion A of FIG. 24 at each application of the address pulse Pa, the intensity of the discharge (i.e., the secondary discharge DCS) in the discharge cell in which the addressing discharge DCA is not generated is almost equal to that in the driving method of the first preferred embodiment. Therefore, the driving method of the fourth preferred embodiment can keep the contrast high like that of the first preferred embodiment.

Further, between the secondary discharge DCS and the addressing discharge DCA, there are not only a difference in discharge intensity but also a characteristic difference in whether the discharge between the electrodes X and Y is thereby induced or not. With this characteristic difference, the sustain discharge is reliably generated in the discharge cell in which the addressing discharge DCS is generated while a wrong sustain discharge can be reliably prevented in the discharge cell in which only the secondary discharge DCS is generated. This produces effects of stabilizing the sustain discharge operation and enlarging the driving margin.

Furthermore, as discussed in the second preferred embodiment in detail, it is possible for the pulse Pxc and the address pulse Pa to share the power supply of the circuit for generating the pulses, and therefore the driving device becomes simplified and the manufacturing cost can be reduced. Moreover, in this case, it is possible to control the voltage of the pulse Pxc, i.e., the above voltage $\Delta Vt$ only with the timing of stopping the pulse Pxc, and therefore the intensity of the secondary discharge DCS can be easily optimized.

Further, when the address pulse Pa and the pulse Pxc share the power supply, the voltage of the address pulse Pa and that of the pulse Pxc change in response to each other. Therefore, when the voltage Vxg of the address pulse Pa is controlled, depending on the individual difference of the PDP 51, since the values of the voltage of the pulse Pxc and the voltage $\Delta Vt$ at the same time in response to that, the voltage control can be simplified in the manufacturing process of the plasma display device.

In particular, when the CR waveform is used as the pulse Pxc, since the voltage of the address pulse Pa, the voltage of the pulse Pxc and the voltage ΔVt change in proportion, by setting the voltage Vxg high in the PDP whose discharge voltage is high, all the voltage of the address pulse Pa, the voltage of the pulse Pxc and the voltage ΔVt can be set high in proportion to the voltage Vxg. Conversely, by setting the voltage Vxg low in the PDP whose discharge voltage is low, all the voltage of the address pulse Pa, the voltage of the pulse Pxc and the voltage ΔVt can be set low in proportion to the voltage Vxg. Thus, in accordance with the property of the individual PDP, all the voltage of the address pulse Pa, the voltage of the pulse Pxc and the voltage ΔVt can be easily controlled to the optimal values.

The case where the voltage ΔVt is set to the voltage Vysc and the voltage applied to the electrode Y in the addressing period is set to zero (in other words, no secondary scanning pulse Pysc is applied) in the driving method of the fourth preferred embodiment corresponds to the driving method of the second preferred embodiment. Therefore, the driving method of the second preferred embodiment also produces the same effect as the that of the fourth preferred embodiment can produce.

<The Fifth Preferred Embodiment>

Figure 27:
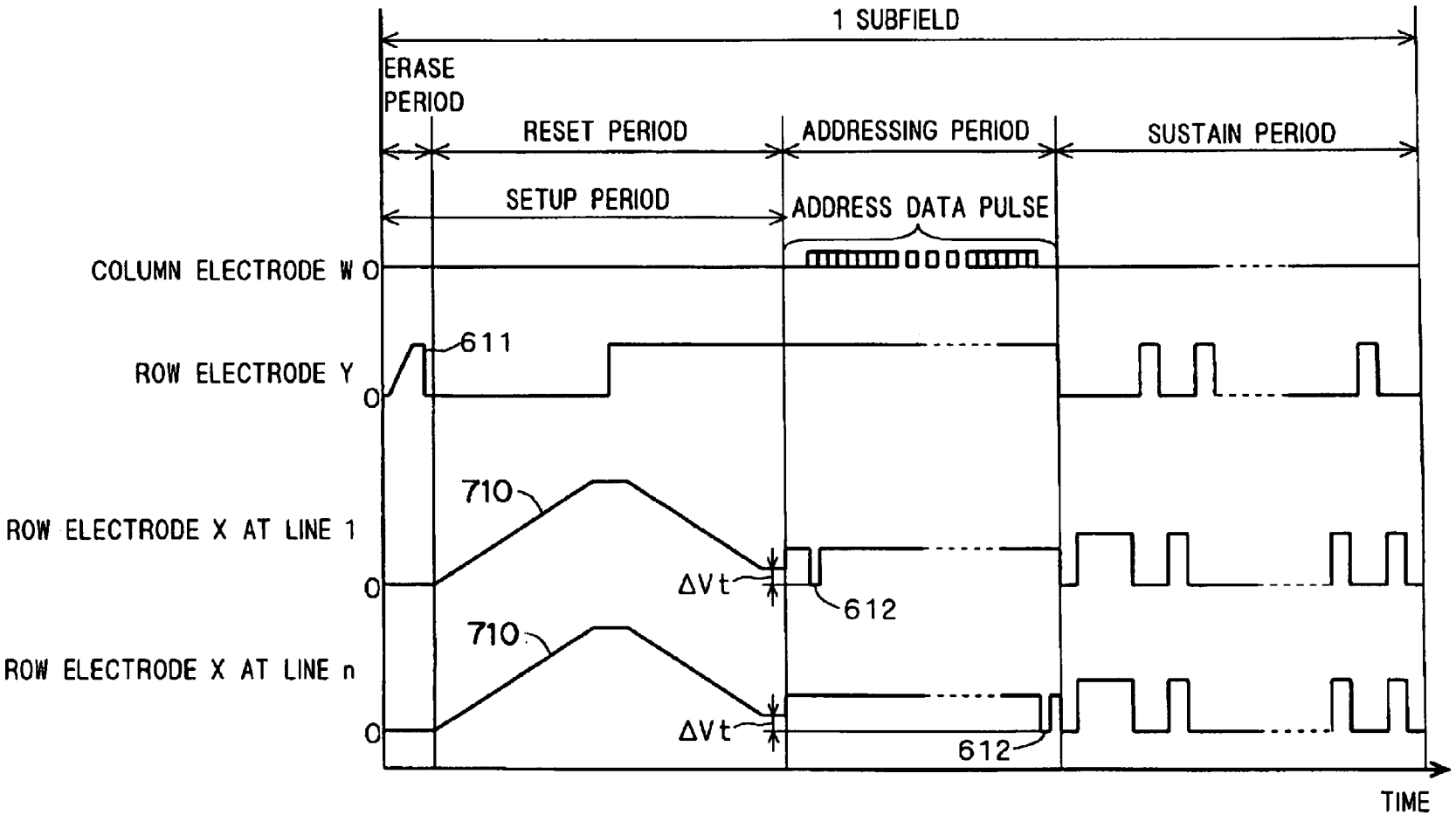
FIG. 27 is a timing chart used for explaining a method of driving a plasma display panel in accordance with a fifth preferred embodiment of the present invention.

The driving method of the fourth (and the second) preferred embodiment can be applied to the second background-art driving method shown in FIG. 30, and an example of this application will be discussed in the fifth preferred embodiment. FIG. 27 is a timing chart used for explaining a method of driving a PDP in accordance with the fifth preferred embodiment of the present invention. FIG. 27 shows waveforms of voltages applied to the column electrode W, the row electrode Y, the row electrode X at line 1 and the row electrode X at line n.

As shown in FIG. 27, in the driving method of the fifth preferred embodiment, a ramp pulse or trapezoidal pulse (voltage pulse) 710, instead of the ramp pulse 610 of FIG. 30, is applied in the reset period. The ramp pulse 710 can be generated by using the pulse generation method (or pulse generation unit) for generating th ramp pulse 610 and can rise like the ramp pulse 610. While the ramp pulse 610 falls up to the same potential as an address pulse 612, however, the ramp pulse 710 is generated by stopping the voltage change before reaching the same potential as the address pulse 612. Specifically, in the continuous fall of the ramp pulse 610 from the maximum value (the first voltage) to the minimum value (the second voltage), the change of the ramp pulse 610 is stopped at the point of time when the voltage of the ramp pulse 610 reaches the voltage ΔVt between the maximum value (the first voltage) and the minimum value (the second voltage), to generate the ramp pulse 710.

After stopping the fall of the ramp pulse 710, in the addressing period, the address pulse 612 is sequentially applied to define whether the discharge cell should be illuminated for display or not in the sustain period.

The fall of the ramp pulse 710 has the last gentle waveform in the reset period, like in the driving method of the fourth preferred embodiment, and the direction of the voltage change is the same as that of the address pulse 612 and the voltage further changes towards the potential of the address pulse 612. Specifically, the ramp pulse 710 changes, at the fall, from the maximum value to the minimum value (in other words, the voltage decreases), and similarly the address pulse 612 for generating the addressing discharge changes in the direction of decreasing the voltage.

Therefore, in the driving method of the fifth preferred embodiment, by stopping the fall of the ramp pulse 710 which is applied in the reset period before reaching the potential of the address pulse 612, a very weak discharge (secondary discharge) is generated in the application of the address pulse 612 to uniformize the discharge delay time τd in the generation of the addressing discharge, like in the fourth preferred embodiment and the like. As a result, the fifth preferred embodiment can produce the same effect as the fourth preferred embodiment and the like produce.

Furthermore, the above discussion in the first to fifth preferred embodiments also applies to a case where the PDP 51 is a PDP having a structure in which the first and second electrodes are opposed to each other with the discharge space sandwiched therebetween (so-called a counter two-electrode type PDP).

While the invention has been shown and described in detail, the foregoing description is in all aspects illustrative and not restrictive. It is therefore understood that numerous modifications and variations can be devised without departing from the scope of the invention.

What is claimed is:

1. A plasma display device, comprising:

a plasma display panel comprising a discharge cell including a first electrode and a second electrode; and a driving unit for driving said discharge cell by giving a potential difference between said first electrode and said second electrode, wherein said driving unit comprises a pulse generation unit capable of generating an operational voltage pulse derived from a predetermined pulse waveform, said predetermined pulse waveform changing from a first voltage to a second voltage, said driving unit controls said pulse generation unit to start outputting said operational voltage pulse to be applied to said first electrode at said first voltage and then to stop the continuous change of said operational voltage pulse when said operational voltage pulse reaches a third voltage, the third voltage being between said first voltage and said second voltage, and a waveform of said operational voltage pulse is the same as the predetermined pulse waveform between said first voltage and said third voltage.

2. The plasma display device according to claim 1, wherein said third voltage is set on the side of said second voltage relative to a firing voltage, and said operational voltage pulse reaches said third voltage after a time longer than a discharge delay time passes from the point of time when said operational voltage pulse exceeds said firing voltage.

3. The plasma display device according to claim 1, wherein said operational voltage pulse includes at least one of a CR voltage pulse, a ramp voltage pulse and an LC resonant voltage pulse.

4. The plasma display device according to claim 3, wherein said pulse generation unit is capable of generating a rectangular voltage pulse, and said driving unit controls said pulse generation unit to output a voltage pulse in which one of said CR voltage pulse, said ramp voltage pulse and said LC resonant voltage pulse is superimposed on said rectangular voltage pulse, as a voltage to be applied between said first electrode and said second electrode.

5. The plasma display device according to claim 1, wherein when one field for image display is divided into a plurality of subfields each including an addressing period and a sustain period set after said addressing period, whether said discharge cell should be illuminated or not in said sustain period is determined in said addressing period and said discharge cell is illuminated in said sustain period if it is determined in said addressing period that said discharge cell should be illuminated, said driving unit starts and stops applying said operational voltage pulse in a period other than said addressing period and said sustain period in at least one of said subfields in said one field.

6. The plasma display device according to claim 5, wherein said driving unit performs, with said operational voltage pulse, at least one of an operation for generating a discharge in said discharge cell regardless of a display history and an operation for generating a discharge in said discharge cell only when said discharge cell is illuminated in the immediately preceding sustain period.

7. The plasma display device according to claim 5, wherein said driving unit starts outputting said operational voltage pulse as a voltage to be applied to said first electrode before said addressing period, and said third voltage of said operational voltage pulse is set to a value between a ground potential and an address voltage applied to said first electrode in said addressing period in determining that said discharge cell should be illuminated in said sustain period.

8. A plasma display device, comprising:

a plasma display panel comprising a discharge cell including a first electrode and a second electrode; and a driving unit for driving said discharge cell by giving a potential difference between said first electrode and said second electrode, wherein one field for image display is divided into a plurality of subfields each including an addressing period and a sustain period set after said addressing period, an address voltage is applied to said first electrode and whether said discharge cell should be illuminated or not in said sustain period is determined in said addressing period, and said discharge cell is illuminated in said sustain period when it is determined in said addressing period that said discharge cell should be illuminated, and wherein said driving unit performs the steps of:

(a) generating a first voltage pulse having the same polarity as said address voltage has, for generating a discharge in said discharge cell to generate wall charges, and outputting said first voltage pulse as a voltage to be applied to said first electrode; and (b) generating a second voltage pulse having the same polarity as said first voltage pulse has, for generating a discharge in said discharge cell to control the state of said wall charges, and outputting said second voltage pulse as a voltage to be applied to said first electrode, both said steps (a) and (b) are performed before said addressing period and said step (b) is performed after said step (a), and said first voltage pulse and said second voltage pulse have waveforms of which absolute values continuously increase toward a predetermined polarity.

9. The plasma display device according to claim 8, wherein said driving unit further performs the step of:

(c) generating a third voltage pulse having a polarity reverse to that of said first voltage pulse and outputting said third voltage pulse as a voltage to be applied to said first electrode, said step (c) is performed between said step (a) and said step (b), and said third voltage pulse has a waveform of which absolute value continuously increases toward a predetermined polarity.

10. The plasma display device according to claim 8, wherein said driving unit further performs the step of:

(d) reducing said wall charges in said discharge cell, and said step (d) is performed before said step (a).

11. The plasma display device according to claim 10, wherein said driving unit sequentially performs, in said step (d), the steps of:

(d-1) generating a fourth voltage pulse for generating a discharge in said discharge cell and outputting said fourth voltage pulse as a voltage to be applied between said first electrode and said second electrode; and (d-2) generating a fifth voltage pulse for generating a discharge in said discharge cell and outputting said fifth voltage pulse as a voltage to be applied between said first electrode and said second electrode, said fourth voltage pulse is a voltage pulse which is capable of generating a discharge at the rise and the fall of said fourth voltage pulse, and said fifth voltage pulse has a waveform of which absolute value continuously increases toward a predetermined polarity.

12. A plasma display device, comprising:

a plasma display panel comprising a discharge cell including a first electrode and a second electrode; and a driving unit for driving said discharge cell by giving a potential difference between said first electrode and said second electrode, wherein said driving unit generates a discharge in said discharge cell during an operation for defining whether said discharge cell is illuminated for display or not, regardless of whether said discharge cell is illuminated for display or not, said driving unit comprises a pulse generation unit capable of generating an operational voltage pulse derived from a predetermined pulse waveform, said predetermined pulse waveform changing from a first voltage to a second final voltage, said driving unit controls said pulse generation unit to start outputting said operational voltage pulse to be applied to said first electrode at said first voltage, then to stop the change of said operational voltage pulse when said operational voltage pulse reaches a third voltage, the third voltage being between said first voltage and said second voltage and thereafter to perform said operation for defining whether said discharge cell is illuminated for display or not, and a waveform of said operational voltage pulse is the same as the predetermined pulse waveform between said first voltage and said third voltage.

13. The plasma display device according to claim 12, wherein said plasma display panel comprises a plurality of said discharge cells, and said discharge includes a first discharge and a second discharge weaker than said first discharge, said driving unit performs the operations, as said operation for defining whether said discharge cell is illuminated for display or not, of:

sequentially applying an address pulse to said first electrode of each of said plurality of discharge cells to sequentially select said plurality of discharge cells, generating said first discharge in a selected one of said plurality of discharge cells when a data pulse is applied to said second electrode of said selected discharge cell, and generating said second discharge in said selected discharge cell when said data pulse is not applied to said second electrode of said selected discharge cell.

14. The plasma display device according to claim 12, wherein said operational voltage pulse have a pulse width which varies as a function of an amplitude of said third voltage.

15. The plasma display device according to claim 12, wherein, a first constant voltage is applied to said second electrode during the continuous change of said operational voltage pulse.

16. The plasma display device according to claim 15, wherein said discharge cell further comprises a third electrode facing said first and second electrode, and another constant voltage is constantly applied to said third electrode during the continuous change of said operational voltage pulse.

17. The plasma display device according to claim 12, wherein said operational voltage pulse continuously changes at a varying rate of change.

18. The plasma display device according to claim 1, wherein said operational voltage pulse have a pulse width which varies as a function of an amplitude of said third voltage.

19. The plasma display device according to claim 1, wherein a first constant voltage is applied to said second electrode during the change of said operational voltage pulse.

20. The plasma display device according to claim 19, wherein said discharge cell further comprises a third electrode facing said first and second electrode, and a second constant voltage is applied to said third electrode during the continuous change of said operational voltage pulse.

21. The plasma display device according to claim 1, wherein said operational voltage pulse continuously changes at a varying rate of change.

* * * * *